US009718516B2

(12) United States Patent
Read

(10) Patent No.: US 9,718,516 B2
(45) Date of Patent: Aug. 1, 2017

(54) TRIMARAN HULL AND BOAT

(71) Applicant: PENOBSCOT EAST RESOURCE CENTER, INC., Stonington, ME (US)

(72) Inventor: Douglas Andrew Read, Damariscotta, ME (US)

(73) Assignee: Maine Center for Coastal Fisheries, Stonington, ME (US)

( * ) Notice: Subject to any disclaimer, the term of this patent is extended or adjusted under 35 U.S.C. 154(b) by 29 days.

(21) Appl. No.: 14/870,075

(22) Filed: Sep. 30, 2015

(65) Prior Publication Data

US 2016/0090154 A1 Mar. 31, 2016

Related U.S. Application Data

(60) Provisional application No. 62/057,284, filed on Sep. 30, 2014.

(51) Int. Cl.
*B63B 1/12* (2006.01)

(52) U.S. Cl.
CPC ..... *B63B 1/125* (2013.01)

(58) Field of Classification Search
CPC ..... B63B 1/125
USPC ..... 114/61.1
See application file for complete search history.

(56) References Cited

U.S. PATENT DOCUMENTS 4,091,761 A * 5/1978 Fehn ..... B63B 1/042 114/271
4,095,549 A * 6/1978 Williams ..... B63B 1/125 114/123
4,348,972 A * 9/1982 Parsons ..... B63B 1/042 114/357
D283,416 S * 4/1986 Carlson ..... B63B 1/125 D12/312

(Continued)

FOREIGN PATENT DOCUMENTS

EP 0 271 939 A1 6/1988
EP 2 571 750 B1 6/2014

(Continued)

OTHER PUBLICATIONS

"2014-2018 Strategic Plan," Penobscot East Resource Center Pamphlet, www.penobscoteast.org/mission-and-vision/strategic-plan/, Feb. 2014, (8 pages).

(Continued)

*Primary Examiner* — Lars A Olson
*Assistant Examiner* — Jovon Hayes
(74) *Attorney, Agent, or Firm* — Finnegan, Henderson, Farabow, Garrett & Dunner LLP.

(57) ABSTRACT

A trimaran boat is provided. The trimaran boat may have a pair of sidehulls, a center hull positioned between the pair of sidehulls, and a deck extending substantially continuous from one sidehull across the center hull to the other sidehull. A trimaran boat hull is also provided. The trimaran boat hull may have a pair of sidehulls, a center hull positioned (Continued)

between the pair of sidehulls, a deck extending substantially continuous from one sidehull across the center hull to the other sidehull. The trimaran boat hull may also have a pair of center hull transitions and a pair of sidehull transitions. The trimaran boat may also be configured such that a transom of each sidehull is v-shaped.

19 Claims, 31 Drawing Sheets

(56) References Cited

U.S. PATENT DOCUMENTS

| | | | | |
|---|---|---|---|---|
| 4,644,890 | A | 2/1987 | Lott | |
| 5,415,120 | A | 5/1995 | Burg | |
| 5,529,009 | A * | 6/1996 | Faury | B63B 1/125 114/123 |
| 5,582,126 | A * | 12/1996 | Rypinski | B63B 1/125 114/352 |
| 5,934,215 | A * | 8/1999 | Burg | B63B 1/042 114/273 |
| 6,435,123 | B1 * | 8/2002 | Odegard | B63B 1/24 114/125 |
| 7,040,244 | B1 | 5/2006 | Ferran | |
| 7,237,500 | B2 * | 7/2007 | Armstrong | B63B 1/06 114/39.25 |
| 7,418,915 | B2 * | 9/2008 | Campbell | B63B 1/20 114/288 |
| 7,497,179 | B2 * | 3/2009 | Dize | B63B 1/121 114/271 |
| 8,342,114 | B2 | 1/2013 | Goubault et al. | |
| 8,707,880 | B2 * | 4/2014 | Armstrong | B63B 39/06 114/122 |
| 8,707,881 | B2 * | 4/2014 | Armstrong | B63B 1/125 114/211 |
| 8,807,058 | B1 * | 8/2014 | Roche, IV | B63C 11/26 114/61.1 |
| 8,833,284 | B1 * | 9/2014 | Resta | B63B 1/125 114/282 |
| 2008/0276850 | A1 * | 11/2008 | Immonen | B63B 35/08 114/41 |
| 2011/0056425 | A1 | 3/2011 | Campbell et al. | |
| 2012/0132118 | A1 * | 5/2012 | Armstrong | B63B 39/06 114/122 |
| 2012/0137945 | A1 * | 6/2012 | Armstrong | B63B 1/125 114/72 |
| 2016/0090154 | A1 * | 3/2016 | Read | B63B 1/125 114/61.1 |

FOREIGN PATENT DOCUMENTS

| | | | |
|---|---|---|---|
| FR | 2584365 | A1 | 1/1987 |
| WO | WO 98/36961 | A1 | 8/1998 |
| WO | WO 2012/016295 | A1 | 2/2012 |

OTHER PUBLICATIONS

"Austal Trimaran Technology," *Austal*, www.austal.com/Resources/Deliveries/4a74c8d1-9ece-4ea8-8693-bcf8493e31cf/trimaran-technology-lowres.pdf, accessed on Oct. 1, 2014 (6 pages).

"Green Lobster Boat," *Penobscot East Resource Center*, http://www.penobscoteast.org/programs/green-lobster-boat/, © 2014 Penobscot East Resource Center, accessed on Oct. 1, 2014, (4 pages).

Alden, Robin, "*Penobscot East Resource Center News: Penobscot East Looks to Fuel-Efficient Boat and Local Bait Sources, Part 3 of 4*," Island Ad-Vantages, Nov. 10, 2011, (1 page).

Brophy, Jessica, "'*Green' Lobster Boat Passes Seaworthiness Tests*," Island Ad-Vantages, Published Jul. 18, 2013, http://islandadvantages.com/news/2013/jul/18/green-lobster-boat-passes-seaworthiness-tests/#.Vgwla_lVhHw/, accessed Sep. 30, 2015 (1 page).

Brophy, Jessica, "*Workshop Gives Tips, Tricks, and Designs for Lobster Boat Fuel Efficiency*," Island Ad-Vantages, Published Nov. 23, 2011, http://islandadvantages.com/news/2011/nov/29/workshop-gives-tips-tricks-and-designs-for-lobster/ accessed Sep. 30, 2015, (2 pages).

Crowe, Mike, "*Green Boats Set For Testing*," Fishermen's Voice, Published Dec. 2011, vol. 16, No. 12, http://fishermensvoice.com/122011GreenBoatsSetForTesting.html, accessed Sep. 30, 2015 (2 pages).

Crowley, Michael, "*Design Showcase: Best of Boats & Gear 2014*," National Fisherman, Published Jan. 2015, pp. 32-35.

Crowley, Michael, "*Tri Your Luck: New Multihull Design Could Reduce Fuel Costs for Maine Lobstermen*," Boats & Gear > Boatbuilding, National Fisherman, Published Jun. 2014, (3 pages).

Ebel, Sarah, "*Innovative Fuel-Saving Technologies*," The Working Waterfront, Published by the Island Institute, Dec. 2011/Jan. 2012 (2 pages).

Henderson, Keith, "'*Green" Lobster Boat*," Maritime Propulsion Powering the Marine Industry, Published Apr. 21, 2011, http://articles.maritimepropulsion.com/article/e2809cGreene2809d-Lobster-Boat-7653.aspx, accessed Sep. 30, 2015 (1 page).

Idlebrook, Craig, "*Fuel-Efficient Lobster Boat Design Lauded*," The Working Waterfront, vol. 26, No. 4, Published Jun. 2013, Published by the Island Institute, (1 page).

Idlebrook, Craig, "*Fuel-Efficient Lobster Boat Design Moving Forward*," The Working Waterfront, Published May 13, 2014, http://www.workingwaterfrontarchives.org/2013/05/13/fuel-efficient-lobster-boat-design-moving-forward/ , accessed Sep. 30, 2015, (2 pages).

Mobimar 18 Wind Brochure, www.mobimar.com/index.php?action=file&file-action=download&file-id=30, accessed on Oct. 1, 2014 (2 pages).

Moretto, Mario, "*New Lobster Boat Design Could Increase Fuel Efficiency by 25 Percent," Bangor Daily News*, Published Jul. 23, 2013, http://bangordailynews.com/2013/07/23/news/hancock/new-lobster-boat-design-could-increase-fuel-efficiency-by-25-percentt/print/, accessed Sep. 30, 2015, (2 pages).

Penobscot East Resource Center, "'*Green" Lobster Boat Sea Trials*," https://www.youtube.com/watch?v=OSrwvuB3GZw; Published on Aug. 27, 2013.

Schreiber, Laurie, "*Green Boats, Acid Water: 2011 Forum Looks Up The Road*," Fishermen's Voice, Published Apr. 2011, vol. 16, No. 4, http://www.fishermensvoice.com/archives/0411index.html, accessed Sep. 30, 2015, (5 pages).

Schreiber, Laurie, "*Naval Architect: Trimaran Lobsterboat Could Save 30 Percent In Fuel*," Courier-Gazette, Published Mar. 27, 2011, http://knox.villagesoup.com/p/naval-architect-trimaran-lobsterboat-could-save-30-percent-in-fuel/385775?cid=3256812/, accessed Sep. 30, 2015, (4 pages).

Swartz, Brian, "*Maine Maritime Academy: 'Greener' Lobster Boats*," Bangor Daily News, Published Saturday, Feb. 25, 2012, (2 pages).

Trotter, "*Fishermen's Forum to Focus on Streamlining Costs," Bangor Daily News*, Published Mar. 4, 2009, http://bangordailynews.com/2009/03/04/news/midcoast/fishermenrsquos-forum-to-focus-on-streamlining-costs/, accessed Sep. 30, 2015, (1 page).

Wood, Melissa, "*One, Two, or Three Hulls?*," National Fisherman, Published Thursday, Mar. 6, 2014, www.nationalfisherman.com/blogs/boats-gear/3111-one-two-or-three-hulls, accessed Sep. 30, 2014, (3 pages).

* cited by examiner

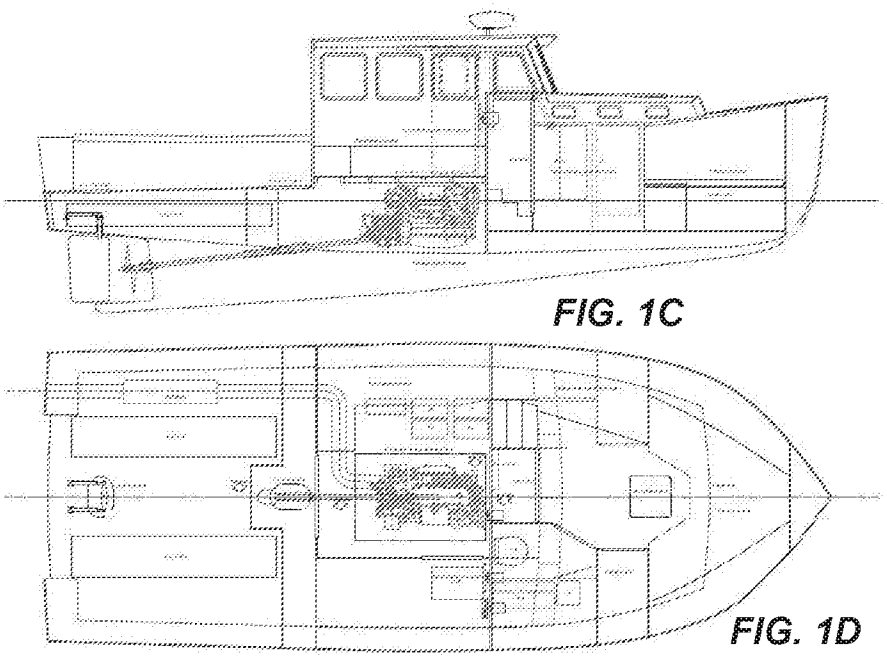
FIG. 1C
FIG. 1D
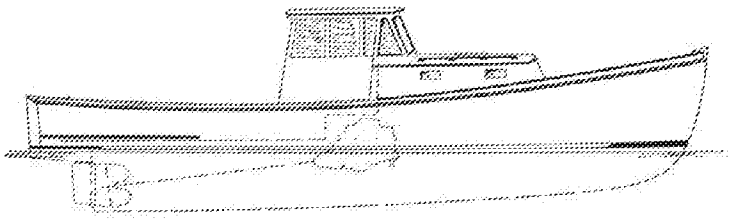
FIG. 1A
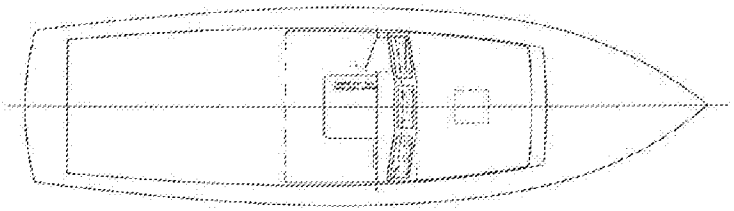
FIG. 1B
(Prior Art)

FIG.13A
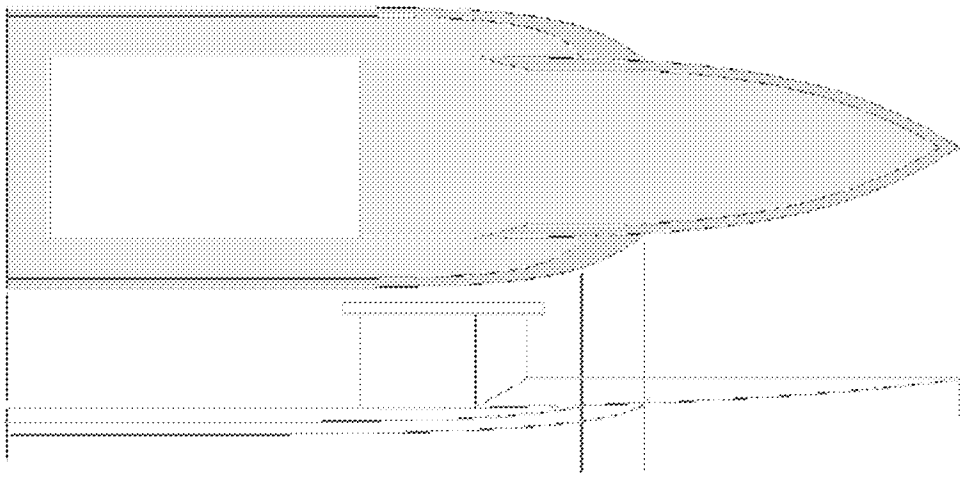
FIG.13B
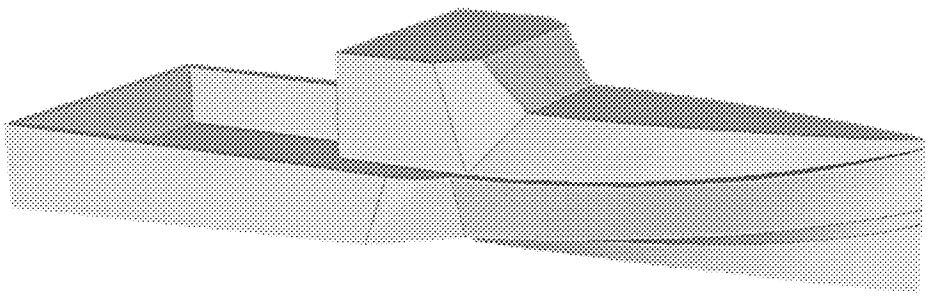
FIG.13C

TRIMARAN HULL AND BOAT

RELATED APPLICATIONS

This application claims the benefit of U.S. Provisional Application No. 62/057,284, filed Sep. 30, 2014, which is incorporated by reference in its entirety.

TECHNICAL FIELD

The present disclosure is directed to a hull and boat, and more particularly, a trimaran hull and boat.

BACKGROUND

Making a living is becoming harder and harder for the commercial lobsterman, as overhead costs for fuel, equipment, and bait steadily climb, while volatility in the prices earned by lobster catches can send values tumbling. The current trend in lobster boat design is an increased beam, giving more deck space to carry more traps. FIGS. 1A-1D, show two examples of traditional lobster boat design. FIGS. 1A-1B are of a William Frost design circa 1950, and FIGS. 1C-1D are of a current design by Calvin Beal. While the Frost design has a length-to-beam (L/B) ratio of around 3.5, the Beal design has an L/B of about 2.5. The increase in beam, however, tends to drive up the power requirements in the displacement and pre-planing speed range, where these vessels frequently operate. Increased power requirements lead to increased fuel consumption and increased overhead costs.

Therefore, a need exists for an improved lobster boat design, which reduces power requirements and fuel consumption while maintaining other beneficial characteristics of current lobster boats.

Accordingly, the present disclosure is directed to an improved lobster boat design which reduces the power requirements (i.e., engine size) and reduces fuel consumption while providing a large deck space and maintaining overall aesthetics of the boat design.

SUMMARY

In accordance with the present disclosure, one aspect is directed to a trimaran boat. The trimaran boat may include a pair of sidehulls, a center hull positioned between the pair of sidehulls, and a deck extending substantially continuous from one sidehull across the center hull to the other sidehull. The boat may be configured such that the pair of sidehulls each has a length less than half a length of the center hull, a transom of each sidehull is generally flush with a transom of the center hull, and a design water line length of the boat is about 36 to about 38 feet. The boat may also be configured such that a beam of the boat is about 15 feet, the center hull has a beam width of about 3.5 feet, and a centerline of each sidehull is about 7 feet from a centerline of the center hull.

Another aspect of the present disclosure is directed to a trimaran boat. The boat may include a pair of sidehulls, a center hull positioned between the pair of sidehulls, and a deck extending substantially continuous from one sidehull across the center hull to the other sidehull. In some embodiments, the pair of sidehulls may each have a length less than half a length of the center hull. In some embodiments, a transom of each sidehull may be generally flush with a transom of the center hull. In some embodiments, the deck may be configured to store a plurality of lobster pots. In some embodiments, operating at about 16 knots the boat has about a 20% lower power requirement than a comparable monohull boat. In some embodiments, a design water line length of the boat may be about 36 to about 38 feet. In some embodiments, the center hull may have a beam width of about 3.5 feet.

In some embodiments, a centerline of each sidehull may be about 7 feet from a centerline of the center hull. In some embodiments, a beam of the boat may be about 15 feet. In some embodiments, an engine may be positioned in the center hull. In some embodiments, the center hull may have a keel and a draft of about 4 feet and 1 inches. In some embodiments, the boat may have about a 100 horsepower engine and with a displacement of about 12,000 lbs and a propeller efficiency of 65%, the boat consumes about 5.3 gallons per hour of fuel or less operating at about 16 knots. In some embodiments, the boat may have an about 200 horsepower engine and with a displacement of about 12,000 lbs and a propeller efficiency of 65%, the boat consumes about 10.3 gallons per hour of fuel operating at about 20 knots.

Another aspect of the present disclosure is directed to a boat hull. The boat hull may include a pair of sidehulls, a center hull positioned between the pair of sidehulls, and a deck extending substantially continuous from one sidehull across the center hull to the other sidehull. The boat hull may also include a pair of center hull transitions and a pair of sidehull transitions. The boat hull may also be configured such that a transom of each sidehull is v-shaped. In some embodiments, the pair of sidehulls each may have a length less than half a length of the center hull and may be positioned outboard and aft at each side of the hull such that the transom of the sidehulls is generally aligned the transom of the center hull.

In some embodiments, operating between about 14 to about 20 knots provides a maximum energy efficiency. In some embodiments, operating between about 14 to about 20 knots minimizes the power requirement for the hull. In some embodiments, center hull may have a beam width of about 3.5 feet. In some embodiments, the sidehulls are configured and positioned to cut through a bow wave created by the center hull, thereby reducing spray. In some embodiments, the hull has a lower powering requirement than a comparable monohull boat experiencing the same conditions when it has a displacement of less than about 16,000 lbs and operating in a speed range of about 10 knots to about 20 knots.

The accompanying drawing, which is incorporated in and constitutes a part of this specification, illustrates several embodiments of the present disclosure and together with the description, serve to explain the principles of the present disclosure.

BRIEF DESCRIPTION OF THE DRAWINGS

FIGS. 1A and 1B are drawings of a Frost 34' traditional lobster boat and FIGS. 1C and 1D are a Calvin Beal 38' modern traditional lobster boat.

FIGS. 13A, 13B, and 13C are schematics of a lobster boat with a discontinuous sheer line.

FIGS. 15A, 158, and 15C are side views of lobster boat illustrations.

DETAILED DESCRIPTION

Reference will now be made in detail to the present exemplary embodiments of the present disclosure, examples of which are illustrated in the accompanying drawings. Wherever possible, the same reference numbers will be used throughout the drawings to refer to the same or like parts. Although described in relation to a lobster boat, it is understood that the boat and hull design of the present disclosure may be employed for various types of boat and hull designs and applications, including, but not limited to other fishing vessels, leisure boats, ferry boats, etc.

The term "about" or "approximately" as used herein means within an acceptable error range for the particular value as determined by one of ordinary skill in the art, which will depend in part on how the value is measured or determined, e.g., the limitations of the measurements system. For example, "about" can mean within one or more than one standard deviation per the practice in the art. Alternatively, "about" can mean a range of up to 20%, such as up to 15%, up to 10%, up to 5%, and up to about 1% of a given value.

Figure 2B:
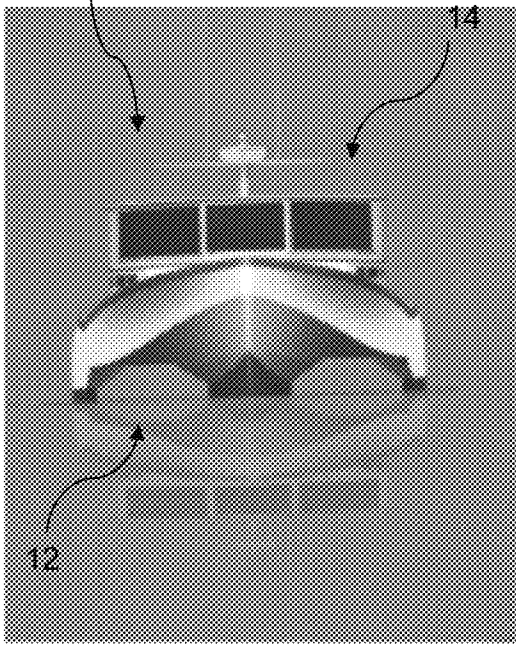
FIG. 2B is a front view of a lobster boat, according to an exemplary embodiment.
Figure 2A:
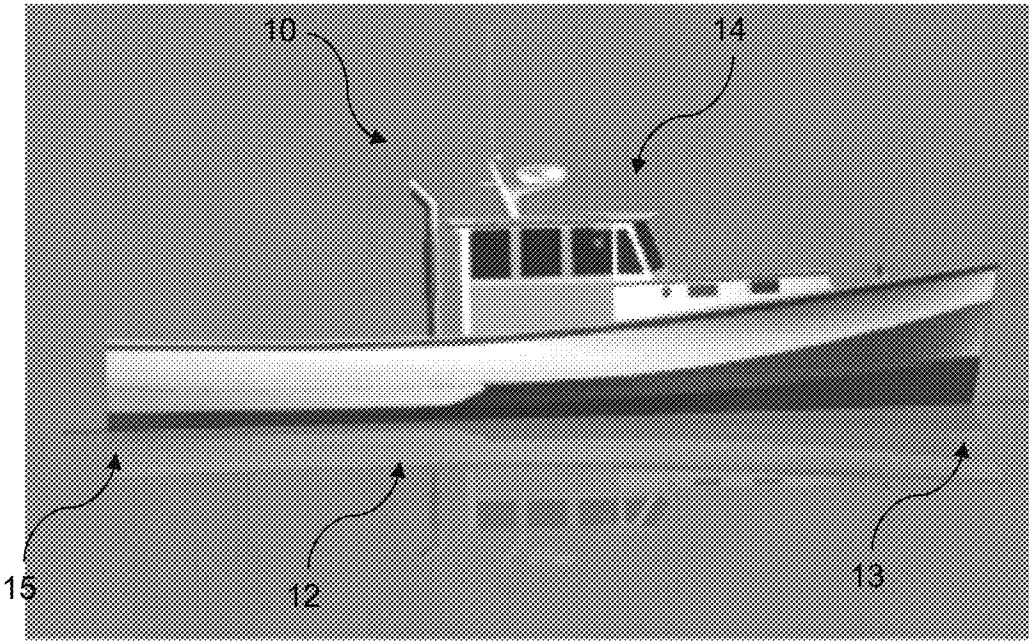
FIG. 2A is a side view of a lobster boat, according to an exemplary embodiment.

FIGS. 2A and 2B show a side and front view of a trimaran lobster boat 10, according to an exemplary embodiment. Boat 10 may include, amongst other things, a hull 12, a superstructure 14 (e.g., wheelhouse). Boat 10 may have a bow end 13 and a stern end 15. Hull 12, as shown in FIGS. 2A and 2B may be a trimaran hull construction. As described herein, a trimaran hull may be a hull with three distinct hulls, connected by a cross-deck structure forming a dry tunnel between the hulls.

Figure 3:
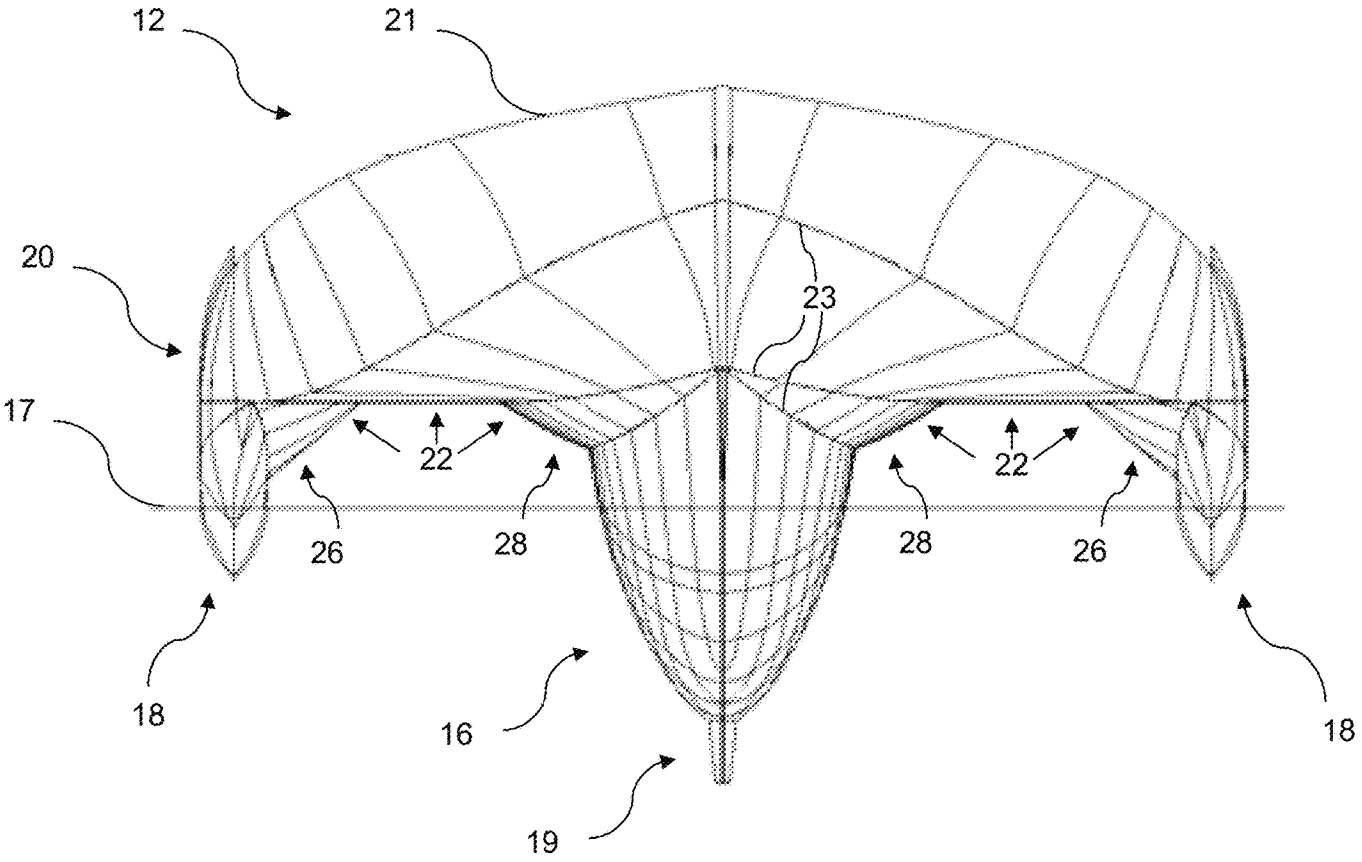
FIG. 3 is a front view body plan of a lobster boat hull, according to an exemplary embodiment.

FIG. 3 is a front body plan view of hull 12 for which boat 10 may be built, according to an exemplary embodiment. As shown in FIG. 3, hull 12 may include a center hull 16 and a pair of sidehulls 18, which may be connected by a cross-deck structure 20. Cross-deck structure 20 may extend substantially continuous from one sidehull across the center hull to the other sidehull. Center hull 16 and sidehulls 18 along with cross-deck structure 20 may form tunnels 22 in between the hulls. Center hull 16 may be the primary hull of hull 12 and boat 10. Boat 10 may include an engine (not shown), which may be positioned primarily within center hull 16. Boat 10 may also include a keel 19 that may extend from center hull 16, which may also sometimes be referred to as a skeg. Boat 10 and hull 12 may have a design water line 17, as shown in FIG. 3.

Hull 12 may extend up from center hull 16 and sidehulls 18 to sheer 21, which may run from bow end to stern end and may separate the side of hull 12 from the deck. As shown in FIG. 3, hull 12 may include at least three chines 23.

According to an exemplary embodiment, center hull 16 may make up about 80% of the total displacement of boat 10. In some embodiments, center hull 16 may make up, for example, about 75%, about 85%, about 90%, or great than about 90% of the total displacement of boat 10. According to exemplary embodiment, center hull 16 may have a length-to-beam ratio (L/B), for example, of greater than about 10. In some embodiments, center hull 16 may have a length-to-beam ration (L/B/) of greater than about 8, about 9, about 11, or about 12. According to an exemplary embodiment, center hull 16 may have a prismatic coefficient (i.e., volume of water displaced divided by waterline length times the cross-sectional area of the midship section), for example, greater than about 0.65.

Figure 4:
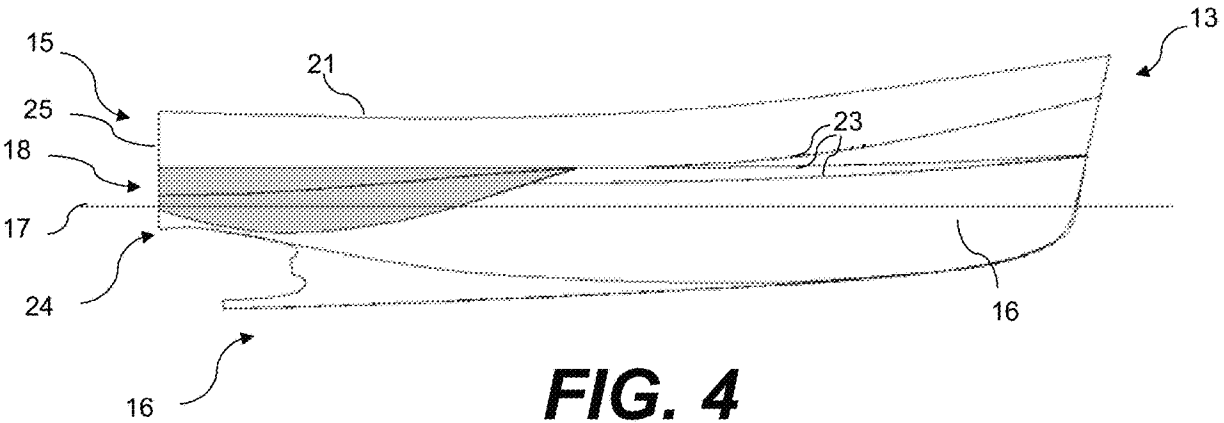
FIG. 4 is a side view sheer plan of a lobster boat hull, according to an exemplary embodiment.

As shown in FIG. 4, the center hull 16 may have a transom stern 25 with a stern wedge 24. The stern wedge 24 may be configured to act as a trim tab integrated into the shape of hull 12 at the stern end 15. In some embodiments, stern wedge 24 may be replaced with a stern flap, which may be a continuous trim tab set at a fixed angle. Stern wedge 24 may be configured to control the running trim of boat 10 depending on the speed of the boat (e.g., in the semi-planing speed range). Stern wedge 24 may be configured to reduce the resistance of center hull 16. For example, in some embodiments, stern wedge 24 may reduce the resistance of center hull 16 by about 10%. The running trim without stern wedge 24 can be up to about 4 degrees, while the running trim with stern wedge 24 may be between about 1 and about 1.5 degrees, which is preferred. In some embodiments, because hull 12 may be designed so it does not plane, reducing the trim from about 4 degrees to about 1 degree decreases several resistance components due to reduced wetted surface and transom submergence.

According to an exemplary embodiment, sidehulls 18 may each make up, about 10% of the total displacement. In some embodiments, the sidehulls 18 may each make up, for example, about 12.5%, about 7.5%, about 5%, or less than about 5% of the total displacement of boat 10. According to an exemplary embodiment, a length of sidehulls 18 to a length of center hull 16 may range between, for example, about 30% to 45%, about 31% to about 45%, about 32% to about 45%, about 33% to about 45%, or about 35% to about 45%. As shown in FIG. 4, hull 12 may be configured such that all of each sidehull 18 may be positioned between midship (i.e., midpoint between bow end 13 and stern end 15) and stern end 15. The positioning of sidehulls 18 may be configured relative to center hull 16 (transversely and longitudinally) such that the sidehulls 18 provide stability while minimizing resistance. Sidehulls 18 may be configured to emerge from and plunge into the water as boat 10 rolls. To avoid slamming, sidehulls 18 may have a generally v-shaped cross-section along a longitudinal axis of boat 10.

According to an exemplary embodiment, sidehulls 18 may have a length-to-beam ratio (L/B), for example, of greater than about 12. In some embodiments, the length-to-beam ration (L/B) of sidehulls 18 may be, for example, greater than about 8, about 9, about 10, about 11, about 13, or about 14.

Tunnels 22 may be defined as the open space between center hull 16 and sidehulls 18 on each side of center hull 16, formed by cross-deck structure 20 connecting them, as shown in FIG. 3. The tunnels may be configured to be dry when boat 10 is at rest and when in operation (e.g., semi-planing speeds) they may be configured so that they do not act as planing surfaces or lift devices at speed (e.g., through air compression or hydrodynamic lift). The tunnel height off the water line may be about half the freeboard (i.e., distance from the waterline to the upper deck level, measured at the lowest point of sheer) at midships.

As shown in FIG. 3, hull 12 may define sidehull transitions 26 between each sidehull 18 and cross-deck structure 20. Sidehull transitions 26 may include an angled surface connecting each sidehull 18 and to cross-deck structure 20. The shape of sidehull transition 26 may affect stability characteristics of boat 10 and hull 12. Traditional boats have been designed with increasing beam to get high deck area. This trend however has driven initial stability to very high values, but roll periods tend to decrease to short "snappy" values. Boat 10 having hull 12 may be configured to have sufficient but lower initial stability, reducing roll accelerations and decreasing fatigue on the operator. Sidehull transition 26 can affect getting the correct righting arm curve to balance stability and roll period. Boat 10 having hull 12 has been shown to have a 50% longer roll period than comparable (e.g., similar length) monohull designs.

As shown in FIG. 3, hull 12 may also define center hull transitions 28. Center hull transitions 28 may include angled surfaces between center hull 16 and cross-deck structure 20. Center hull transitions 28 may be beneficial in a variety of ways. For example, the additional volume created by the center hull transition 28 within hull 12 may create additional room for fitting an engine 30 (not shown) into the center hull. In addition, center hull transitions 28 provide structural continuity by eliminating a sharp corner between center hull 16 and cross-deck structure 20.

Boat 10 having hull 12, as described herein, was developed as a result of several phases of development, which included designing, testing, redesigning, and retesting.

Phase I Development

Phase I of development included, among other things, preparing a list of preferred design performance and features, hull form development and optimization, and construction and testing of a ⅛ scale model. The preferred design performance and features for boat 10 included, for example, transit speeds between 14-20 knots, a large deck area (e.g., capacity to carry increased number of traps), traditional aesthetics, carrying capacity of up to 50% of light displacement, improved seakeeping characteristics, similar cost to current designs, and full keel (e.g., for roll damping, propeller protection, beaching).

Hull Selection

With regard to transit speed, the desired speed range (i.e., 14-20 knots) for boat 10 was well above hull speed, which is generally considered the maximum speed for a displacement vessel. The hull speed for a given boat is determined by the speed-length ratio, with hull speed occurring at a speed-length ratio of 1.33 such that:

$$V_k = 1.33\sqrt{L_{WL}} \qquad \text{Equation (1)}$$

Using this equation for a waterline length of 36 ft., hull speed is about 8 knots. Therefore, for the vessel to exceed this speed, the hull must be either of planing or semi-planing design, or it must be narrower for its length.

Traditional lobster boat designs utilize a round-bilge semi-planing style hull, which is well suited to this speed range just above hull speed. Therefore it was determined that a radical change in hull form may be preferred to make significant improvements. Examining the options of narrow hulls led to multi-hull designs, namely catamarans and trimarans. These configurations allow the vessel to exceed hull speed by using long, slender hulls, but require multiple hulls to maintain stability. Multihull designs allow for the decoupling of resistance and stability such that the beam can be increased independent of requirements for power.

An initial trade-off study was conducted on both a catamaran and trimaran design. Both of these hull configurations provide a desired power reduction. An optimization study concluded that neither was significantly better than the other. The power requirement was within +/−5% across the entire speed range, with the catamaran showing a slight advantage in the lower speed range and the trimaran slightly better in the higher speed range. In the desired design speed range (i.e., 14-20 knots), the difference between the two was negligible.

Based on these results, the determination of the preferred hull design came down to the remaining preferred design performance and features. For example, both catamaran and trimaran options provide large deck area. Both are equally penalized in carrying capacity by their lower waterplane area, but can be designed to accommodate the load corresponding to 50% of light displacement. The remaining preferred features tended to favor the trimaran design. For example, the long center hull 16 of the trimaran design allows the topside to include a traditional sheer 21, whereas the catamaran typically has a blunt bow and flatter sheer. Seakeeping was more difficult to evaluate in general terms, but the trimaran could be designed to have less initial stability due to the distribution of waterplane area. A desire for lower initial stability may seem counter to improved seakeeping characteristics, but the increased beam of current designs has driven initial stability up, resulting in short roll periods that increase fatigue on the operators. Catamarans, on the other hand, have all of their waterplane area distributed far from the centerline (high waterplane inertia, at least when constrained to reasonable load capacity and space for an engine) and therefore will have high initial stability and short roll periods.

Additional seakeeping concerns included pitch motion and cross-deck slamming. The narrow hulls of both catamarans and trimarans should allow the hull to act as a wave-piercer up to a certain sea state, reducing pitch motion. Cross-deck slamming is a concern with both configurations, though a trimaran has generally less flat cross-deck area than a catamaran. Assuming a catamaran would have two engines (though single engine asymmetric catamarans have been built), the single-engine trimaran should have an advantage in initial and maintenance cost. The single large center hull of a trimaran allows the design to retain a traditional keel for roll damping, beaching, and protection of the propeller. In addition, trimarans can be designed with a more traditional aesthetic.

Based on these factors, the trimaran hull design option with a full-length keel and traditional inboard diesel engine was selected as the baseline of the design. Initial calculations from existing hull data produced an estimated power reduction to be on the order of 20-25% at speeds below 20 knots for a trimaran vessel.

Hull Geometry

Multihulls at the preferred lobster boat size range (e.g., 30-45 ft) present a unique set of proportions unlike those at ship scale (e.g., 300 feet and up). One of the biggest disconnects between boats and ships is the ratio of vessel weight to its length. In ship-scale terms, this ratio is described by either the slenderness ratio or volumetric coefficient. In boat-scale terminology, it is generally described by the displacement-length ratio. In this report we will use boat scale terminology, so comparing small craft to ships we see the following.

Table 1 show below is a comparison of hull proportions.

TABLE 1

| Vessel | 1000 × Vol. Coefficient | Disp.-Length Ratio |
|---|---|---|
| Littoral Combat Ship | 1.5 | 41 |
| Arleigh Burke Destroyer | 2.5 | 72 |
| Lobster Boat | 3.5 | 110+ |

Where the parameters are defined as:

$$C_V = \frac{\nabla}{L^3} \quad \text{Equation (2)}$$

-continued $$Disp.\text{–Length} = \frac{\Delta}{(0.01L)^3} \quad \text{Equation (3)}$$

With L denoting waterline length, ∇ displaced volume, and Δ displaced mass. For the volumetric coefficient, $C_V$, the values can be in any consistent length units. For displacement-length ratio, the mass are in long tons and the length are in feet.

Optimizing any hull design may be a balance between the two main components of resistance: viscous and wave. Viscous resistance is made up mostly of the friction between the water and hull surface, while wave resistance is mostly due to the energy expended generating the wave wake. Balancing these two components can be complex, and may be constrained by practical limits on geometry.

Figure 5:
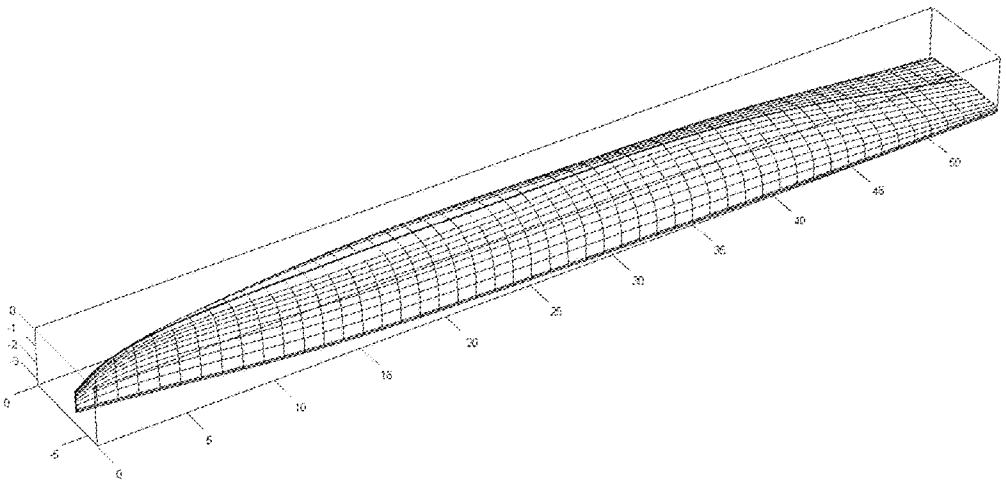
FIG. 5 is a perspective view body plan of a center hull geometry.

During Phase I Development, the center hull was optimized using a genetic algorithm to vary the geometry, assess the performance of candidate configurations, and search the design space for the best solution. Genetic algorithms use the principles of natural selection to search large parametric spaces without getting stuck in a local minimum—a point that is good but not the best of all combinations. The result of this optimization is shown in FIG. 5.

Hull Testing

A hull model was constructed based on a 36 ft. long by 4 ft. wide center hull. A scale ratio of 8 was selected for the model to enable tank and other testing. This ratio gave a model scale waterline length of 54 inches with a beam of 8 inches. In conjunction with constructing the center hull model, two sets of sidehulls were produced and mounted to the model using an aluminum rail system. This configuration allowed the transverse and longitudinal location of the sidehulls to be varied with relative ease.

The model was built of poplar boards, laminated into a solid block. The hull geometry from the computer was translated into a cutting path for the Computer-Numerically-Controlled (CNC) milling machine at Maine Maritime Academy. The precise hull shape was then cut from the poplar block. A similar procedure was used for the sidehulls. The initial design had a target displacement of 10,500 lb.

Existing tank test data for a round-bilge, semi-planing lobster boat hull is limited. Only two publications exist, and these tested the same hull model of a traditional Frost 34 lobster boat. The initial test, performed in the 1960s, only measured the resistance up to 8 knots full scale. In 1981, Pierre De Saix tested the model again at Stevens Institute of Technology in Hoboken, N.J. This time the experiments covered much higher speeds, all the way up to 30 knots full-scale. The data was published in the 1981 issue of National Fisherman. The article presented running trim data and a speed-power curve assuming a conservative 50% propeller efficiency. Using this information, resistance curves were derived for comparison to our tank tests of the trimaran.

The first set of tank tests took place at the Webb Institute Robinson Model Basin. The test matrix, shown in the upper part of Table 2, focused on the center hull only. The goal was to measure the resistance and running trim, and observe the general flow characteristics at the design speed. Several stern wedges and interceptor shapes were attached to the transom of the model to investigate their effects on resistance and trim.

TABLE 2

| | Test | Date | Disp. lb | Speed Range Full | Speed Range High | Bow Original | Bow Modified | Stern None | Stern Plate |
|---|---|---|---|---|---|---|---|---|---|
| 1 | Transom plate | 13 Apr. 2011 | 9700 | X | | X | | | X |
| 2 | Interceptor 1/8" | 13 Apr. 2011 | 9700 | | X | X | | | X |
| 3 | Interceptor 1/4" | 13 Apr. 2011 | 9700 | | X | X | | | X |
| 4 | 10 degree wedge flush | 13 Apr. 2011 | 9700 | | X | X | | | |
| 5 | 10 degree wedge 1/8° | 13 Apr. 2011 | 9700 | | X | X | | | |
| 6 | 10 degree wedge flush - heavy | 14 Apr. 2011 | 12610 | | X | X | | | |
| 7 | 5 degree wedge flush-heavy | 14 Apr. 2011 | 12610 | | X | X | | | |
| 8 | Interceptor flush - heavy | 14 Apr. 2011 | 12610 | X | | X | | | X |
| 9 | No transom plate- heavy | 8 Jun. 2011 | 10253 | | X | | X | X | |
| 10 | Transom plate - heavy | 8 Jun. 2011 | 10253 | | X | | X | | X |
| 11 | Curved shallow | 8 Jun. 2011 | 9700 | | X | | X | | |
| 12 | Curved deep | 9 Jun. 2011 | 9700 | | X | | X | | |
| 13 | Square shallow | 9 Jun. 2011 | 9700 | | X | | X | | |
| 14 | Transom plate | 9 Jun. 2011 | 9700 | | X | | X | | X |
| 15 | Skeg - heavy | 10 Jun. 2011 | 10650 | | X | | X | | |
| 16 | Skeg - correct | 10 Jun. 2011 | 10180 | | X | | X | | |
| 17 | Curved shallow full range | 10 Jun. 2011 | 9700 | X | | | X | | |
| 18 | Short sidehulls no hama strip | 10 Jun. 2011 | 10000 | | X | | X | | |
| 19 | Long sidehulls w hama strip | 11 Jun. 2011 | 10000 | | X | | X | | |
| 20 | Short sidehulls w hama strip | 11 Jun. 2011 | 10000 | | X | | X | | |
| 21 | Short sidehulls final config | 12 Jun. 2011 | 10000 | X | | | X | | |

| | Stern 5 deg W. | Stern 10 deg W. | Stern Trans. 1 | Stern Trans. 2 | Stern Trans. 3 | Stern Offset Flush/NA | Stern Offset 1/8 | Stern Offset 1/4 | Configuration Center | Configuration Skeg | Configuration Trimaran |
|---|---|---|---|---|---|---|---|---|---|---|---|
| 1 | | | | | | X | | | X | | |
| 2 | | | | | | | X | | X | | |
| 3 | | | | | | | | X | X | | |
| 4 | | X | | | | X | | | X | | |
| 5 | | X | | | | | X | | X | | |
| 6 | | X | | | | X | | | X | | |
| 7 | X | | | | | X | | | X | | |
| 8 | | | | | | X | | | X | | |
| 9 | | | | | | X | | | X | | |
| 10 | | | | | | X | | | X | | |
| 11 | | | X | | | X | | | X | | |
| 12 | | | | X | | X | | | X | | |
| 13 | | | | | X | X | | | X | | |
| 14 | | | | | | X | | | X | | |
| 15 | | | X | | | X | | | | X | |
| 16 | | | X | | | X | | | | X | |
| 17 | | | X | | | X | | | X | | |
| 18 | | | X | | | X | | | | | X |
| 19 | | | X | | | X | | | | | X |
| 20 | | | X | | | X | | | | | X |
| 21 | | | X | | | X | | | | | X |

The test gave a baseline resistance and trim curve for the center hull, but showed that the stern shape could be improved. In the full-scale desired speed range (i.e., 14 to 20 knots), the wave trough generated by the hull sat right at the transom, such that the last few inches of the stern were not in the water. The attached stern wedges had no impact in this case, as they were sitting in the air above the wave trough. Correspondingly, the trim angle was high for a displacement hull, on the order of three degrees.

Based on the information from the first test, the hull geometry was modified. Using a 3D printer, five new transom shapes were generated that could be bolted under the stern of the center hull model. Unlike the wedges that had been attached to the transom, these new shapes increased the hull depth in the aft sections so that the stern wedge could operate as intended. Each of the five shapes had a stern wedge built in, but varied the shape and depth of the transom edge. The center hull itself was also modified slightly. In an effort to decrease the size of the bow wave while maintaining the hull shape from the optimization routine, the bow sections were cut in above the waterline. The bow wave crest was observed to run two to three inches up the side of the hull, so it was anticipated that this modification would help decrease the amplitude of the bow wave in way of the sidehulls. The change left the underwater sections alone, forming a sort of bulb shape in the bow.

Figure 6:
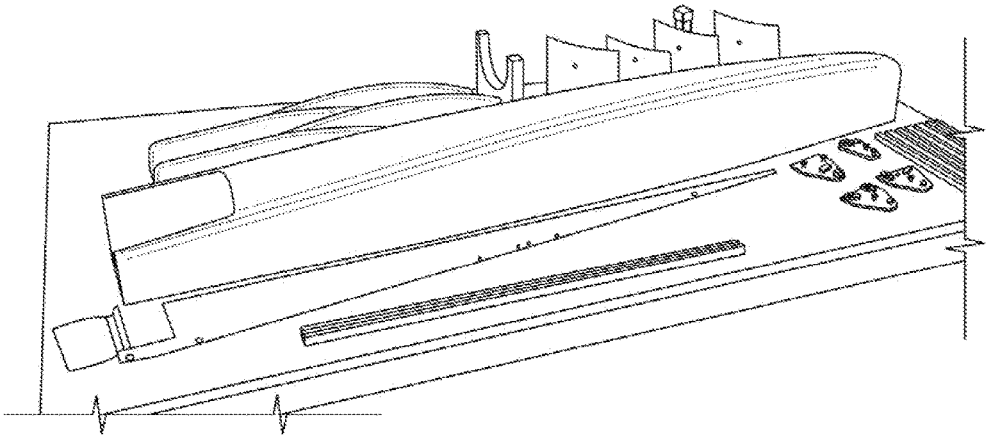
FIG. 6 is a drawing of the model prepared for testing.
Figure 7:
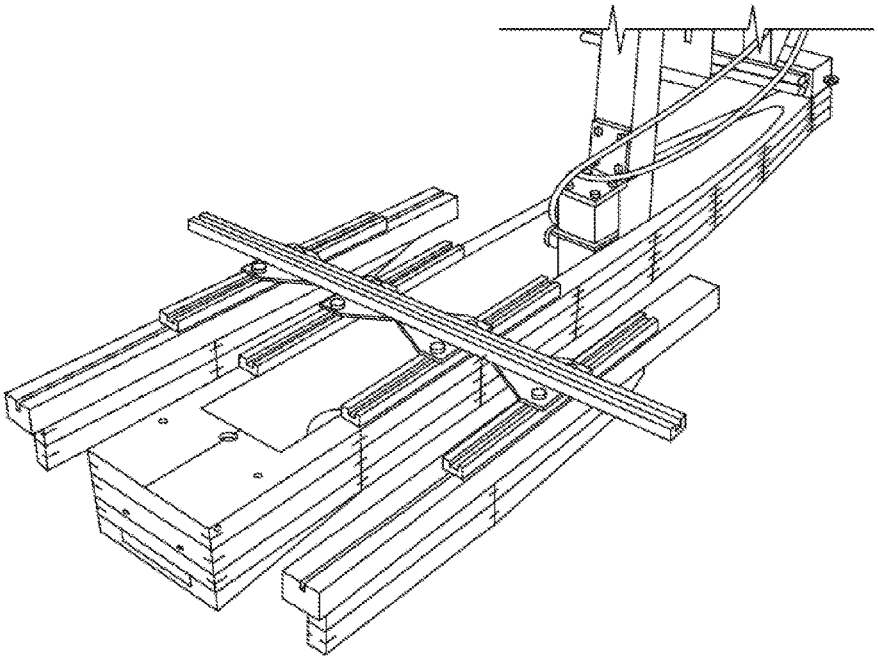
FIG. 7 is a drawing of the full trimaran model configuration for testing.

The complete model for the second tank test is shown in FIG. 6. Note the bow shape modification and five black plastic stern blocks from the 3D printer (one of which is shown bolted in place). A bolt-on keel/skeg was also included, attached by threaded inserts imbedded in the center hull. Two sets of sidehulls are shown behind the center hull, as well as the aluminum brackets and frame rails to attach them to the right of the bow. The fully assembled model is shown in FIG. 7.

For the second set of tank tests the main goal was to test the new stern shapes, select the best one, and continue on to testing the full trimaran configuration. Both sidehull shapes were tested in nine different positions (three possible transverse locations and three possible longitudinal positions). In addition, the impact of the keel was determined. The full test matrix for both the first and second set of Webb tests is shown in Table 2. Note that the keel was tested as an appendage on the center hull, but not on the full trimaran. Hence the trimaran displacement is shown as 10,000 lb., instead of the 10,500 lb. target. The keel displacement for this test was 500 lb. full scale.

It is noted that appendages such as rudders are normally not included due to a mismatch in their friction drag coefficient (i.e., cannot match the viscous flow condition at model scale, only the free-surface wave condition—careful scaling accounts for the difference). The challenge with measuring the drag with a model rudder lies in the fact that its length is much less than the waterline length. Since the keel runs the full length of the boat, its friction drag coefficient will not be mismatched with the hull. Hence in later tests it is acceptable to include the keel as an integral part of the hull and not an appendage. Indeed the keels on the later 1/5.5 scale models are not detachable. The goal with the ⅛ scale model was to make the keel detachable to be able to measure its individual contribution to model resistance.

Data Analysis and Results

The total amount of test data gathered during the tank time is large so the highlights are presented herein, in the context of evolving the design to its current state.

Figure 8:
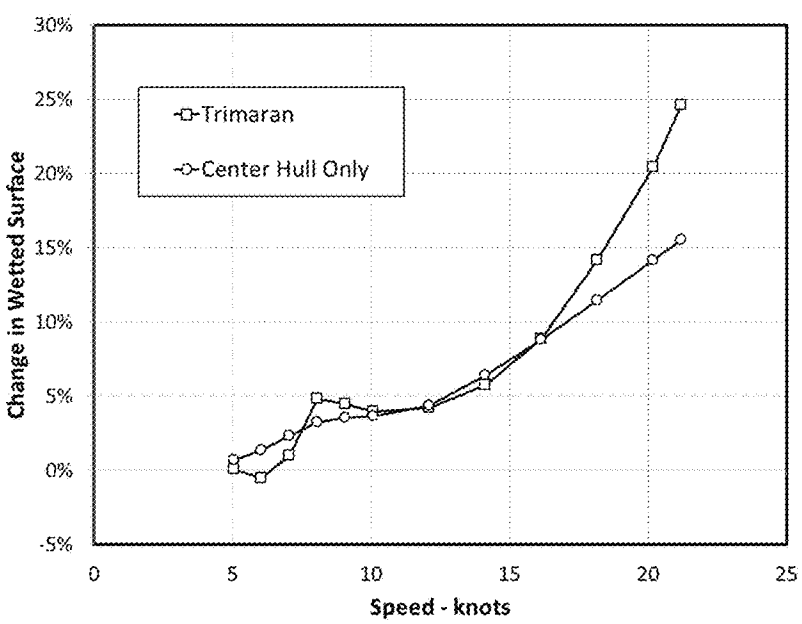
FIG. 8 is a plot of change in wetted surface vs. speed.

To determine the dynamic wetted surface, an estimation of the wetted surface at each speed was computed from photographs, video, and measured sinkage and trim data. While ships operating below hull speed can simply use the at-rest (static) value of hull wetted surface, this does not work for high speed where the bow wave interacts with the rest of the hull. The results of these experiments are shown in FIG. 8, and show a 15-20% increase in wetted surface as the hull reaches 20 knots full scale. In this case each configuration (center hull only and trimaran) has been normalized by its own static wetted surface and presented as percent change from that value. Note the relatively steady increase of the center hull values compared to the more varied result for the trimaran. The difference is due to the center hull bow wave interaction with the sidehulls. As the bow wave crest and trough pass by the sidehulls, they can increase or decrease the total wetted surface as shown. The rapid rise in trimaran wetted surface above about 16 knots is due to a significant interaction with the bow wave, such that a large part of the inboard portion of the sidehulls is wetted, eventually generating spray. The dynamic wetted surface analysis and recommendations to address the issue are discussed herein as part of Phase H Development testing.

Figure 9:
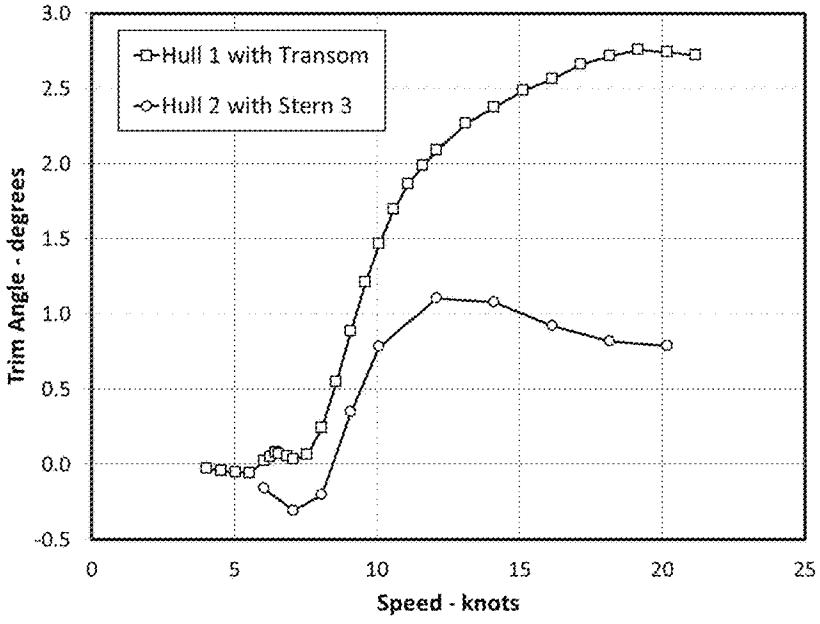
FIG. 9 is a plot of trim angle vs. speed.
Figure 11:
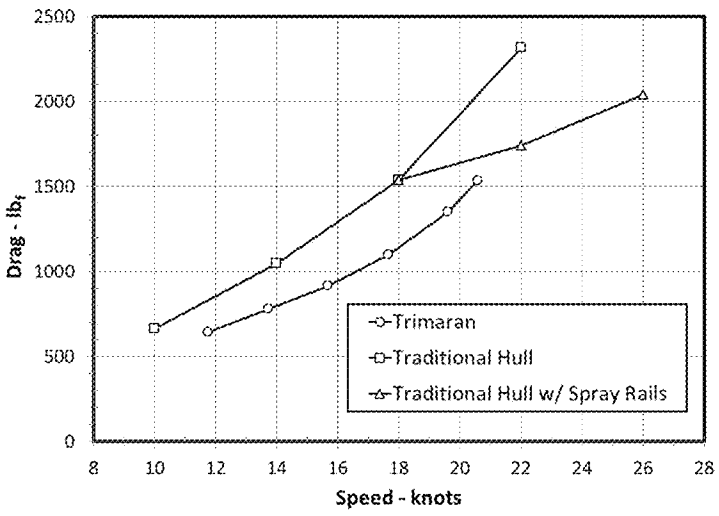
FIG. 11 is a plot of drag vs. speed.
Figure 10:
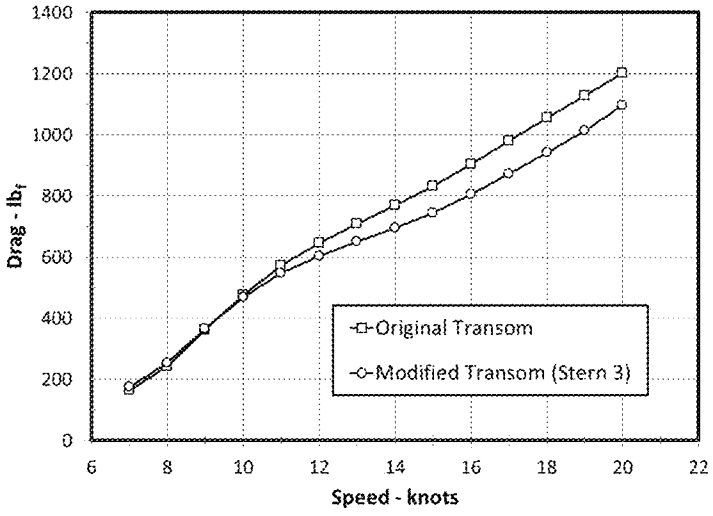
FIG. 10 is a plot of drag vs. speed.

With respect to resistance and trim, the primary results are shown in FIG. 9 to FIG. 11. FIG. 9 shows the change in trim of hull 2 with stern 3 compared to hull 1 with transom, the best of the tested stern blocks. The new stern shape, according to an exemplary embodiment, stays submerged in the wave trough and the wedge reduces the trim angle from over two degrees to about one degree in the design speed range. One degree of trim is generally seen as the target value for high-speed multi-hulls. The stern block impact on resistance is shown in FIG. 10. The benefit may be substantial in the design speed range from 14 to 20 knots, resulting in a 10% decrease in center hull resistance in this range. The final comparison to the traditional Frost 34 data from De Saix is shown in FIG. 11. The selected trimaran configuration shows the desired 20-25% power reduction in the 14-20 knot speed range, at the same displacement.

With respect to the sidehulls, two sets of sidehulls were tested in Phase I Development, one shape long and narrow and the other short and wider with a highly raked stem. The resistance results clearly favored the shorter sidehull shape. Shorter sidehull length may also be preferable because the short waterline length keeps the sidehulls clear of a pot hauling station, which may be positioned on deck, while the raked stem decreased the possibility of catching on pots or lines.

Figure 12:
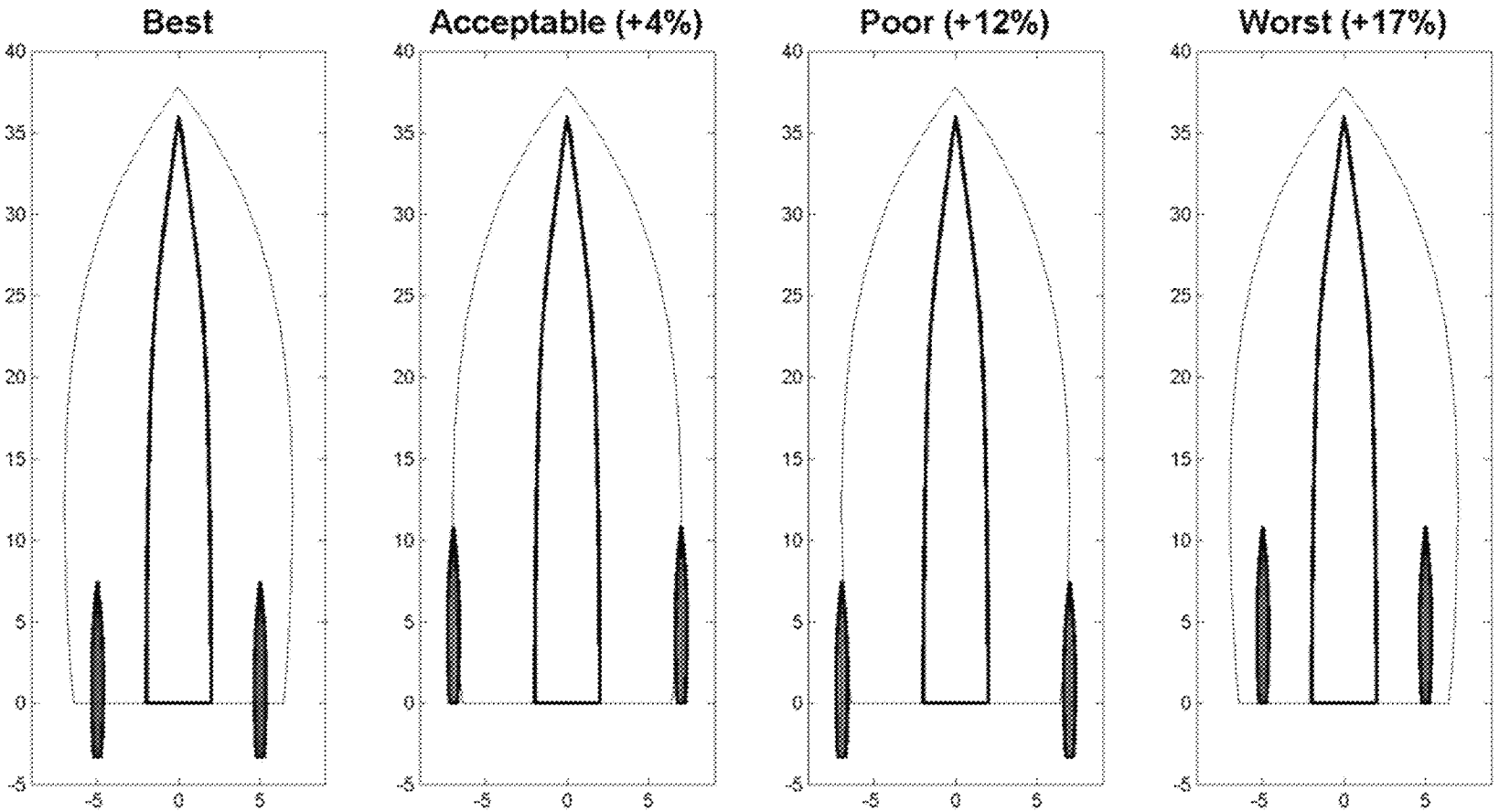
FIG. 12 is a schematic of resistance impact for four sidehull locations.

The general result of the test of the sidehulls is shown in FIG. 12. Four out of the nine sidehull positions are shown, representing the four corners of the 3×3 test position grid. The percent difference between the resistance of each location and the best position is given in each heading.

The best result is the inboard aft position, followed closely by the outboard forward position. The outboard aft and inboard forward positions place the sidehulls directly in the bow wave crest, and give poor results. The aft location of the best position was determined to be impractical due to arrangement and stability concerns, so the "acceptable" position was used going forward in Phase II testing. Modifications to address the 4% penalty for using this configuration are discussed in the next section.

Note that the penalty in the worst position is on the same order of magnitude as the resistance reduction goals for the project. Therefore, choosing the wrong position for the sidehulls could completely eliminate the benefit of using a multihull.

Phase II Development

Phase II Development included, among other things, further hull form development, design of the full hull up to the sheer line, and construction and testing of two 1/5.5 scale models. The scope of testing for Phase II was expanded to include both resistance tests and seakeeping experiments to determine the behavior of the trimaran in waves.

Several modifications to the trimaran were undertaken in Phase II. Due to practical geometry constraints and refined calculations of initial stability, the second best (outboard forward) sidehull position was chosen. This position put the sidehull centerlines seven feet off the center hull centerline, with the transoms off all three hulls lined up. The full beam was about 15 feet. To counter the 4% penalty for this configuration, the main hull was modified slightly. The waterline length was increased from 36 ft. to 36.667 ft. The main hull beam was reduced from 4.0 ft. to 3.5 ft. This change pushed the L/B of the main hull from 9.0 to 10.5 while still allowing room for an inline 4- or 6-cylinder diesel engine. The bow modifications from Phase I (which showed a slight improvement) were abandoned in favor of a narrowing of the entire bow region and a decreased entrance angle.

Figure 14:
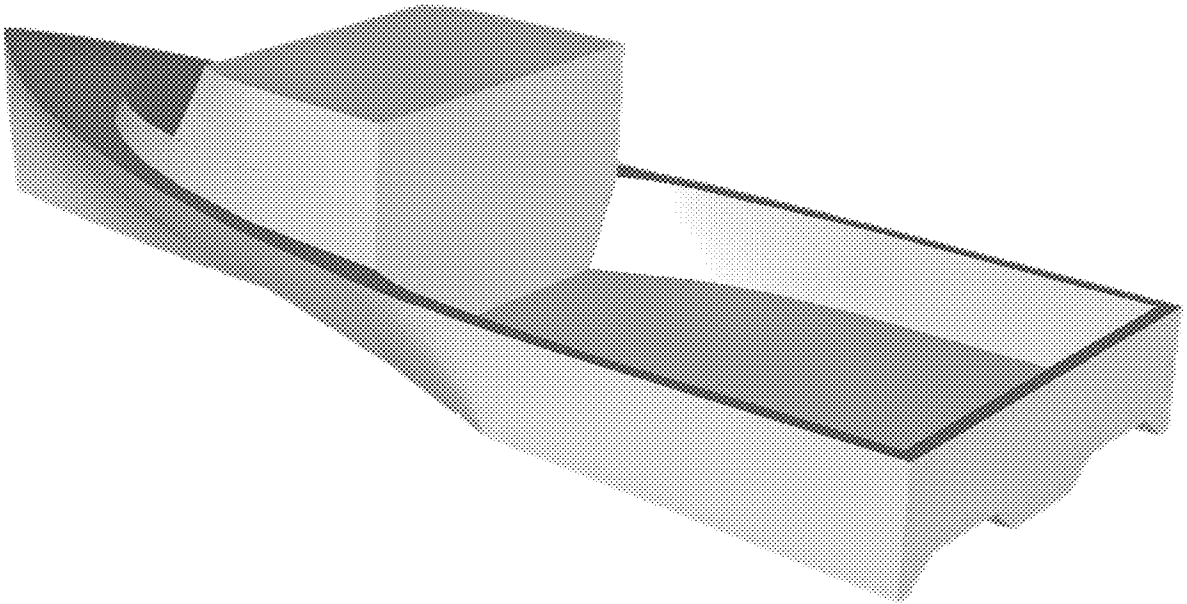
FIG. 14 is a schematic of a lobster boat with a continuous sheer line.
Figure 15A:
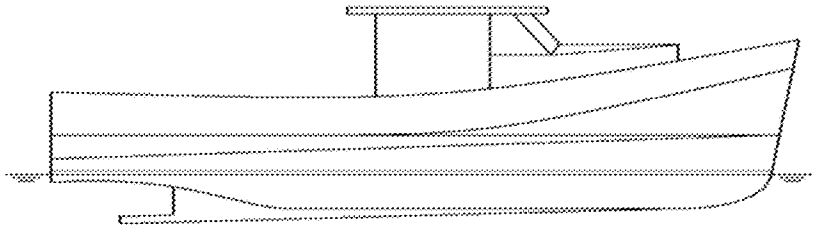
Figure 15B:
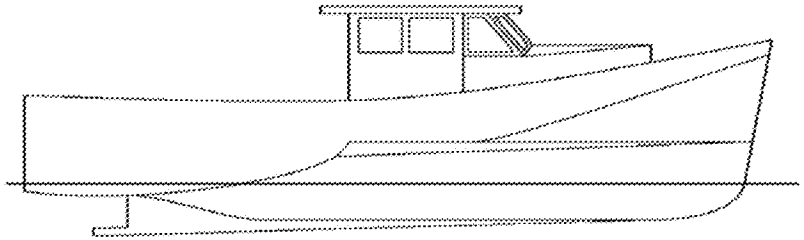
Figure 15C:
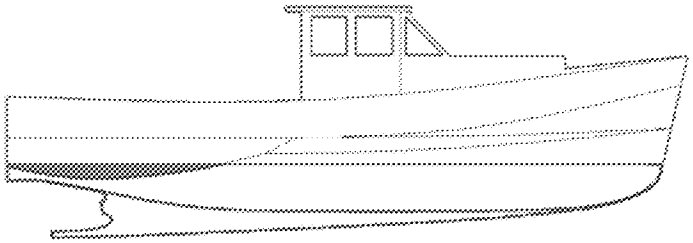
Figure 16:
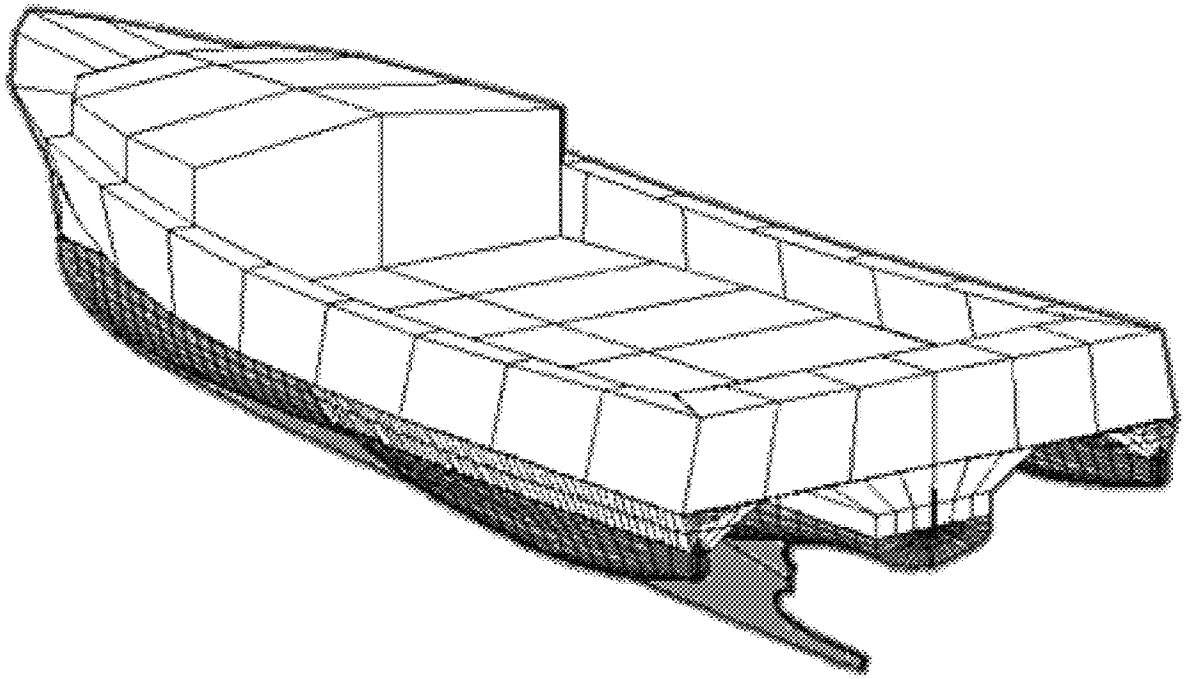
FIG. 16 is a 3D model view of a hull and topside, as built for testing.
Figure 17:
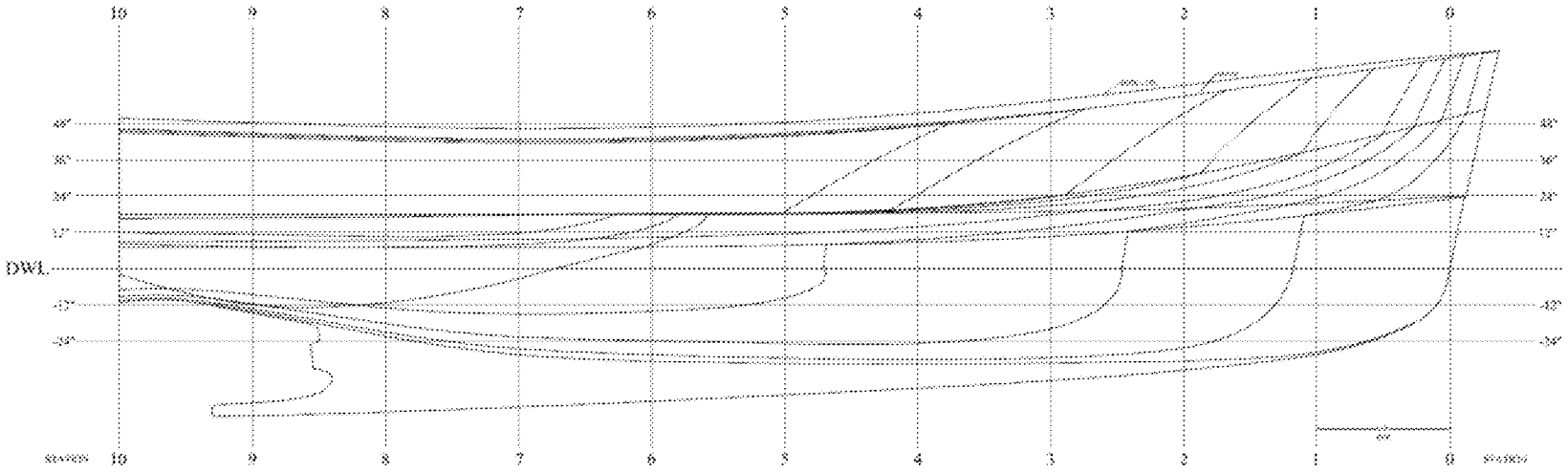
FIG. 17 is a profile view from lines plans of a hull.

Designs of the topside of the boat, the above water portion including sheer line, stem shape, and cross-deck structure to connect the hulls, were all being considered during Phase II Development. Initially, it was thought that a traditional continuous sheer line would be difficult to incorporate with the narrow bow sections. Thus the first few designs included some kind of step or knuckle in the sheer line near amidships, as seen in FIGS. 13A-13C. However, these designs were not preferred due to their aesthetics so designs with a continuous, traditional sheer line, were developed. An example of one of these early designs is shown in FIG. 14. Next, a set of chines were incorporated into the design to define the transitions in the cross deck geometry. This change coupled with a reasonable set of proportions led to the convergence of the topside design shown in FIGS. 15A-C and 16. As shown in FIG. 16, the boat may be configured to have a large deck area. A lines plan was developed and is shown in FIG. 17. Two 1/5.5 scale models were constructed. One model being a modern traditional monohull lobster boat and the other being the trimaran design. The modern traditional boat was based on the dimensions and proportions of boats like the Calvin Beal 38 shown in FIGS. 1D-1F, to reflect the impact of the increased beam and lower L/B of these designs compared to the older Frost 34.

As part of Phase II, a third round of testing at Webb Institute's Robinson Model Basin was conducted. Due to the larger size of the models the maximum full-scale speed was limited to 16.7 knots. All tests were carried out at 12,000 lb. displacement (72.1 lb. model scale) with zero static trim. The Webb test matrix is shown in Table 3.

TABLE 3

| Model | Sidehull | Longitudinal Position | Transverse Position |
|---|---|---|---|
| Modern Traditional | NA | NA | NA |
| Trimaran | Small | Aft | Inboard |
| Trimaran | Large | Aft | Inboard |
| Trimaran | Large | Aft | Outboard |
| Trimaran | Large | Mid | Inboard |
| Trimaran | Large | Fwd | Inboard |

Figure 18:
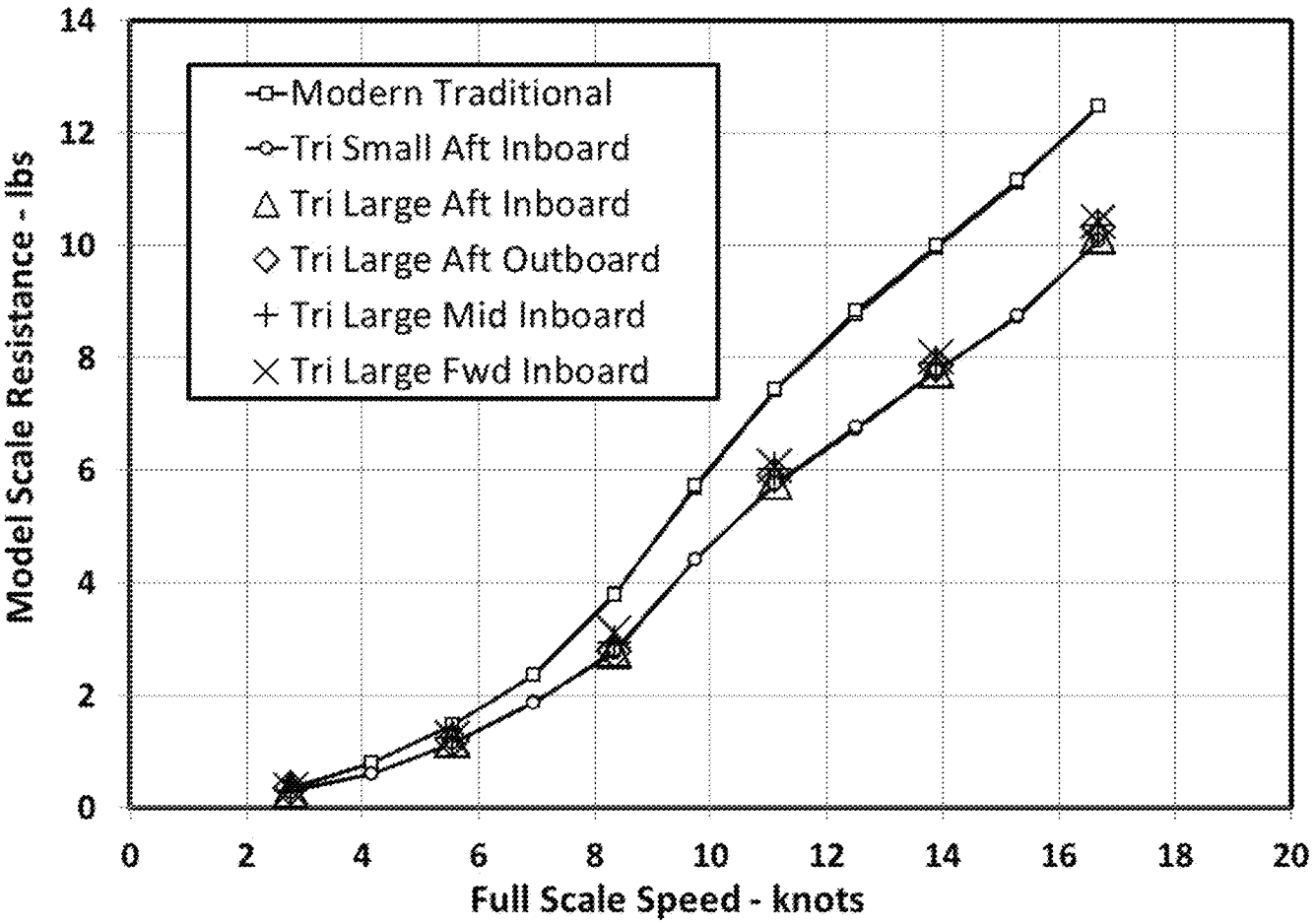
FIG. 18 is a plot of model scale resistance vs. full scale speed.

The results of these experiments are shown in FIG. 18. As a matter of convenience, the data are presented as model scale resistance vs. full-scale speed. The relevant numbers are expanded to full scale in the next section.

The trends in the data show several points. Looking first at the primary data (solid lines) we see that the drag reduction is on the order of 20-25%, as seen in previous tests comparing the trimaran to the narrower Frost 34 hull. As noted earlier, several improvements were made to the trimaran geometry, including increased L/B ratio and narrower entrance angle. The goal of these changes was to push the drag reduction beyond 25%, especially when comparing to a boat with a lower L/B than the De Saix benchmark (L/B=3.5 for the Frost 34 compared to 2.5 for the modern traditional hull). The data may indicate that the modern traditional hull proportions are still well-suited to their purpose, and reinforce the idea that radical geometry changes (such as trimarans) are needed to achieve improvements on the order of 20%.

The second trend from the Webb data shows that the resistance is insensitive to the geometrically similar (but 50% larger) sidehulls, which provide more stability. The open triangles in FIG. 18 show the resistance of the larger sidehulls in the baseline aft-inboard position. This result is encouraging because it shows that transverse stability can be increased without significantly impacting the power requirements. Finally, the three alternate sidehull locations all showed an increase in resistance, confirming the selected sidehull placement.

The final Phase II testing of the trimaran design took place using the Rapid Empirical Innovations (REI) test platform in San Diego, Calif. The REI platform is unique in its approach to model testing; instead of using a traditional tank, REI tows two models at once in open water. The platform is itself a trimaran and is instrumented to measure resistance, x-y-z acceleration, and sea surface elevation. While the resultant data is less precise than a tow tank (as REI points out in their report) the comparison between two models tested in the exact same conditions is accurate.

The total set of experiments conducted using the REI platform was extensive, as shown by the test matrix in Table 4. Tests were conducted in both calm and rough water, at three displacements, two positions of longitudinal center of gravity (LCG), and two "special" conditions for each model. In the case of the trimaran, the special condition was an outboard sidehull position. While the Webb test had already shown this position to be inferior from a resistance perspective, this test included it to assess the additional stability in rough water. For the modern traditional monohull model, the special condition was the addition of a continuous spray rail. The aft LCG position was wet up to give each model about one degree aft static trim.

The resulting data set is extensive, and requires careful attention to the changes in the model wetted surface as a function of speed. Photos and video of both the Webb and REI tests were evaluated to determine the proper scaling of the test data, as documented in the next section.

TABLE 4

| Test Number | Type | Displacement | LCG | Holland Config | Tri Config | Comments |
|---|---|---|---|---|---|---|
| 202 | Calm | 12,000 | Mid | Without Rails | Amas Inboard | |
| 203 | Calm | 15,000 | Mid | Without Rails | Amas Inboard | |
| 204 | Rough | 15,000 | Mid | Without Rails | Amas Inboard | |
| 206 | Calm | 12,000 | Aft | Without Rails | Amas Inboard | 1-5 knots only |
| 207 | Rough | 12,000 | Aft | Without Rails | Amas Inboard | |
| 208 | Rough | 15,000 | Aft | Without Rails | Amas Inboard | |
| 209 | Rough | 12,000 | Mid | Without Rails | Amas Inboard | |
| 210 | Rough | 15,000 | Mid | Without Rails | Amas Inboard | |
| 211 | Rough | 15,000 | Mid | Without Rails | Amas Outboard | |
| 212 | Rough | 12,000 | Mid | Without Rails | Amas Outboard | |
| 213 | Calm | 12,000 | Aft | With Rails | Amas Inboard | |
| 214 | Calm | 12,000 | Mid | With Rails | Amas Inboard | |
| 215 | Calm | 18,000 | Mid | Without Rails | Amas Inboard | |
| 216 | Calm | 15,000 | Aft | Without Rails | Amas Inboard | |
| 218 | Calm | 12,000 | Mid | Without Rails | Amas Outboard | |
| 219 | Calm | 12,000 | Mid | Without Rails | Amas Outboard | |
| 220 | Calm | 12,000 | Aft | Without Rails | Amas Outboard | |

All experimental data were analyzed using the International Towing Tank Conference (ITTC) Procedures and Guidelines for high speed vessels. The reference, Testing and Extrapolation Methods—High Speed Marine Vehicles—Resistance Test, is available from ittc.sname.org (version 7.5-02-05-01 was used in this report). The primary difference between the high speed vessel guidelines and the standard guidelines lies with the careful tracking of the changes in wetted surface with speed. The high speed rules also provide specific guidance for scaling the resistance of trimarans, such that the friction drag effects of the main and sidehulls are accounted for correctly.

The tracking of the wetted surface is important because of the way the friction drag component of resistance must be scaled from the model to the full scale ship or boat. In this case, the values are generated from the measured sinkage and trim values for the models, combined with analysis of the still photographs and video of the tests. A computer program was written to take the experimental sinkage and trim at each speed and calculate a static wetted surface of each model fixed in that position. Video and photos of the model at that speed were then reviewed so that an estimate of the additional wetted surface due to the hull-generated waves could be added to the static value.

Figure 19:
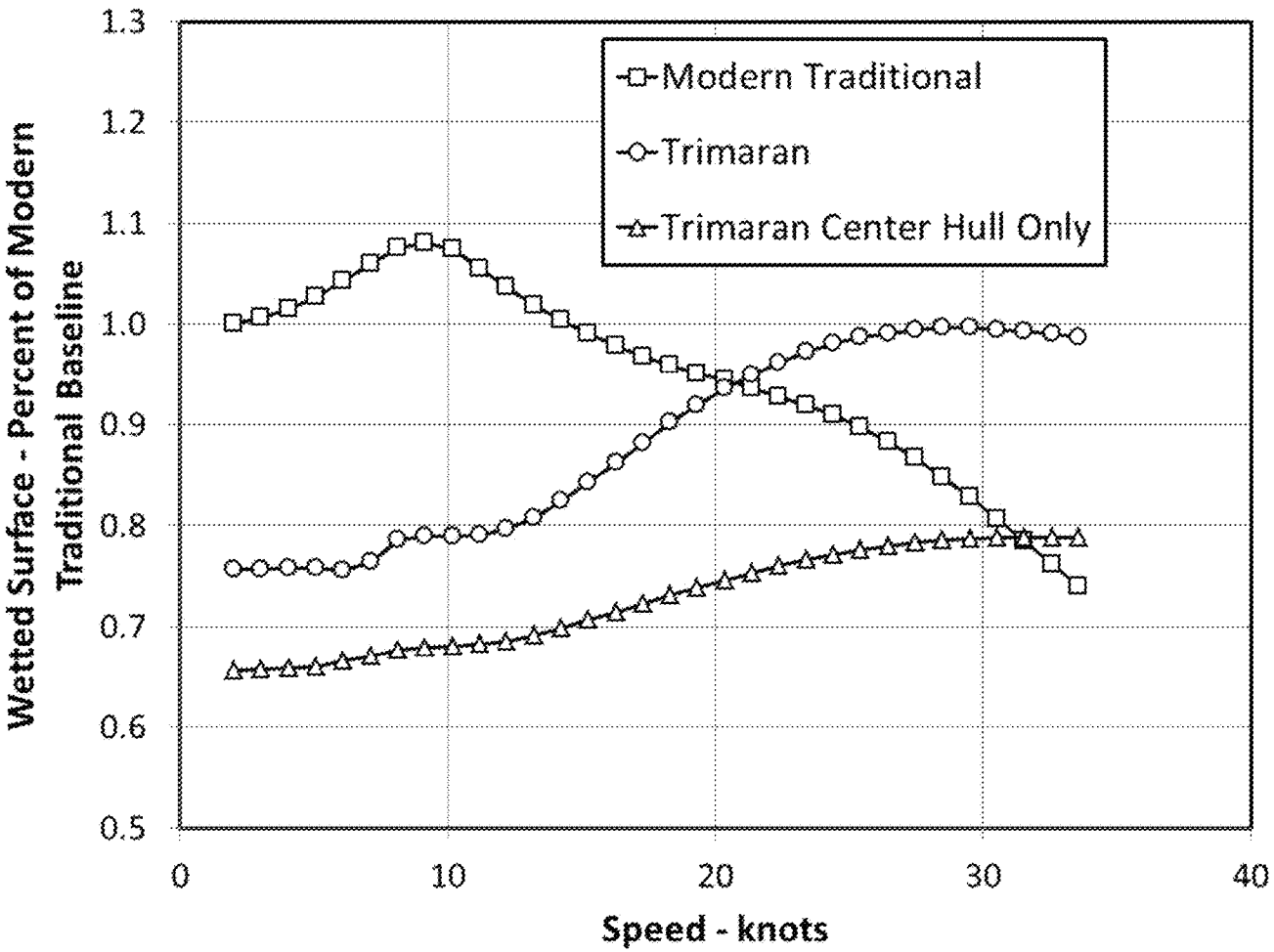
FIG. 19 is plot of wetted surface vs. speed.

The result of this analysis is presented in FIG. 19. All values are normalized by the wetted surface of the modern traditional monohull model at rest. The keel is included in all cases. Looking at the monohull values first, we see the wetted surface starts with a low-speed value of 1.0, since the monohull has been normalized by its own wetted surface. The ratio then rises by about 8% at 9 knots as the hull passes through the pre-planing phase. Beyond about 15 knots, the monohull enters the planing phase, with the wetted surface decreasing by about 25% at 33 knots.

Figure 20:
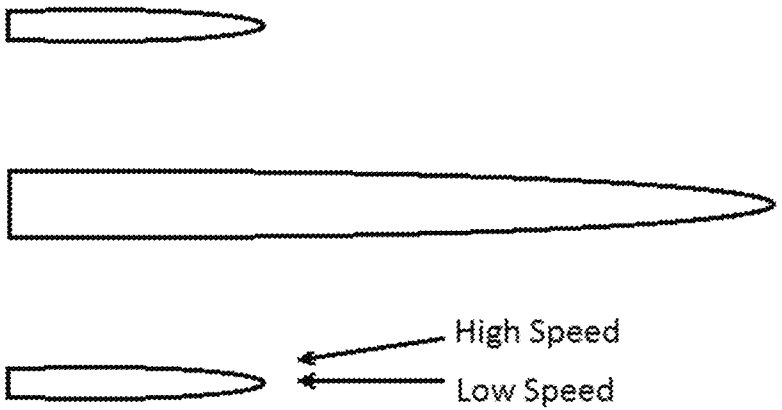
FIG. 20 is a schematic of general flow angle into a sidehull.

The trimaran values show a different trend. The deep, narrow shape of the main hull encloses volume more efficiently, such that at zero speed the trimaran has about 25% less wetted surface than the monohull. As speed increases, the wetted surface increases because the trimaran cannot plane. The first jump in wetted surface occurs around 8 knots, corresponding to hull speed for a 36 ft. waterline. In this case the increase is due to the bow wave crest aligning with the sidehulls. The value then remains constant up to about 12 knots, at which point the interaction of the bow wave with the sidehull and cross-deck structure causes a rapid rise in wetted surface, all the way up to the at-rest value for the monohull (1.0 on the graph). The increase from 15 to 20 knots is significant, over 10%, and is due to the fact that the bow wave from the center hull engulfs the bow of the sidehulls, and may cause the sidehulls to be at a small angle of attack relative to the flow (see FIG. 20). The result is a large wave on the inboard surface of the sidehull, including a large amount of spray at high speeds. A streamwise keel vortex may also be generated by any flow asymmetry, much like the tip vortex on an aircraft wing. Values over 20 knots are calculated in order to scale the entire speed range, but the desired speed range for the design is 14-20 knots cruising.

The center hull only values, as shown in FIG. 19, show the relation between the center hull and sidehull contributions to wetted surface. The sidehulls together represent about 10% of the displacement, but approximately 15% of the wetted surface. As shown by the difference between the trimaran and trimaran center hull only lines, this contribution nearly doubles at high speed. By modifying the sidehull bows and aligning the sidehulls with the flow, the lower 15% value may be extended up to the 20 knot range.

Figure 21:
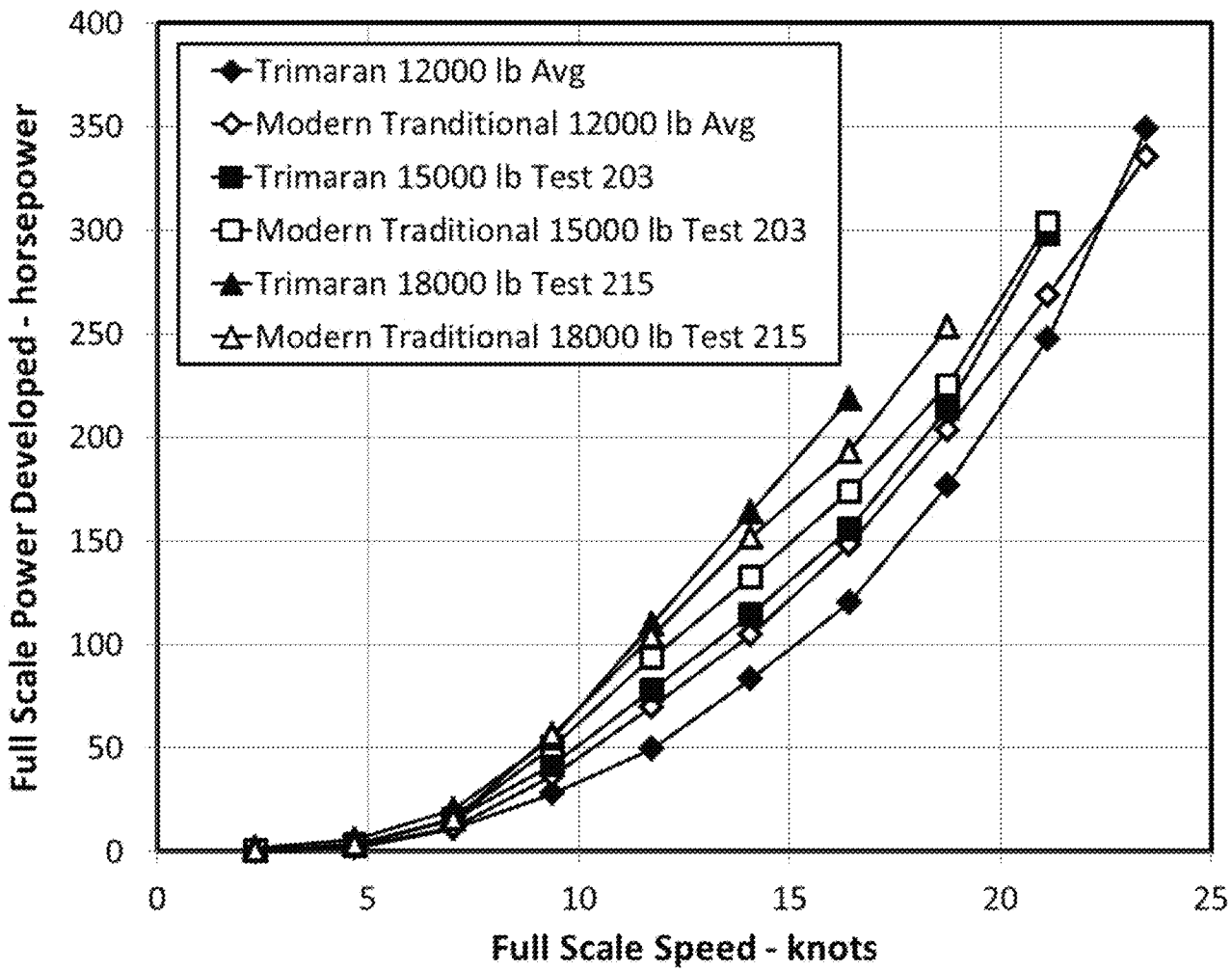
FIG. 21 is a plot of power developed vs. full scale speed.

The basic results of the scaled calm water resistance are presented as power developed vs. speed, as shown in FIG. 21. Power developed takes into account the efficiency of the propeller, representing the power that needs to be produced by the engine to obtain the speeds shown. Propeller efficiency in all cases is assumed to be 65%. Note that the variation in propeller efficiency in practice is of the same order of magnitude as the 20-25% power savings shown by the trimaran. Anecdotal evidence of power or fuel consumption in the field is almost impossible to verify due to variations in propeller efficiency and operating displacement. Actual propeller efficiency on Maine lobster boats may vary from 50-55% on the low end to 70-75% on the high end. To be conservative, De Saix assumed only 50% efficiency in his article in the December 1981 National Fisherman. The value of 65% chosen here is seen as a reasonable high-efficiency goal for the trimaran and is applied equally to the modern traditional monohull.

The scaled data shows the same result as the Webb data in the 12000 lb. case. The REI platform was able to obtain higher speeds, and shows the crossover point where the monohull requires less power than the trimaran to be around 22 knots. The result for 15000 lb., and one of the primary goals for this set of tests, shows that the trimaran maintains a lower power requirement over the speed range of interest with 3000 lb. of additional gear on board. At the heavy displacement of 18000 lb. the monohull requires less power. At this point the trimaran tunnel clearance with the waterline is reduced from 18 inches to about 8 inches. As the tunnels become completely wet in calm water, the trimaran advantage is negated.

Figure 22:
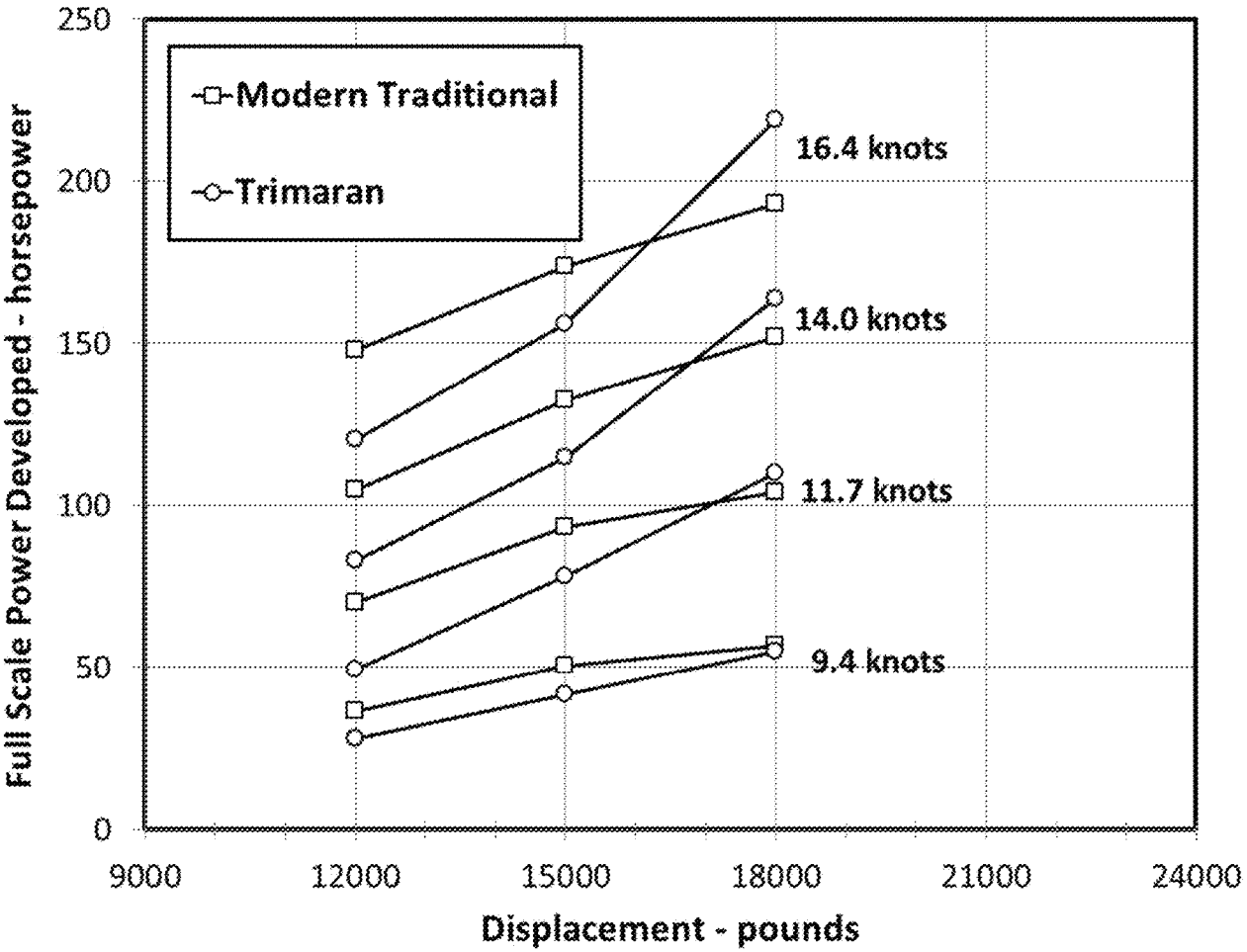
FIG. 22 is a plot of power developed vs. displacement.

The reduction of the trimaran benefit at heavy displacement is to be expected. At some point the draft is increased such that the vessel is no longer behaving as a trimaran with three distinct hulls. The trimaran will essentially become a monohull in this case. The relation between power and displacement is further described in FIG. 22. The data points are the same as in FIG. 21, but are now plotted as a function of displacement for constant speeds. This plot serves to show the displacement crossover point where power is equal for both the monohull and trimaran. This point varies from about 18000 lb. at 10 knots to 16000 lb. at 16 knots, as shown by the points where the lines cross in FIG. 22.

Figure 23:
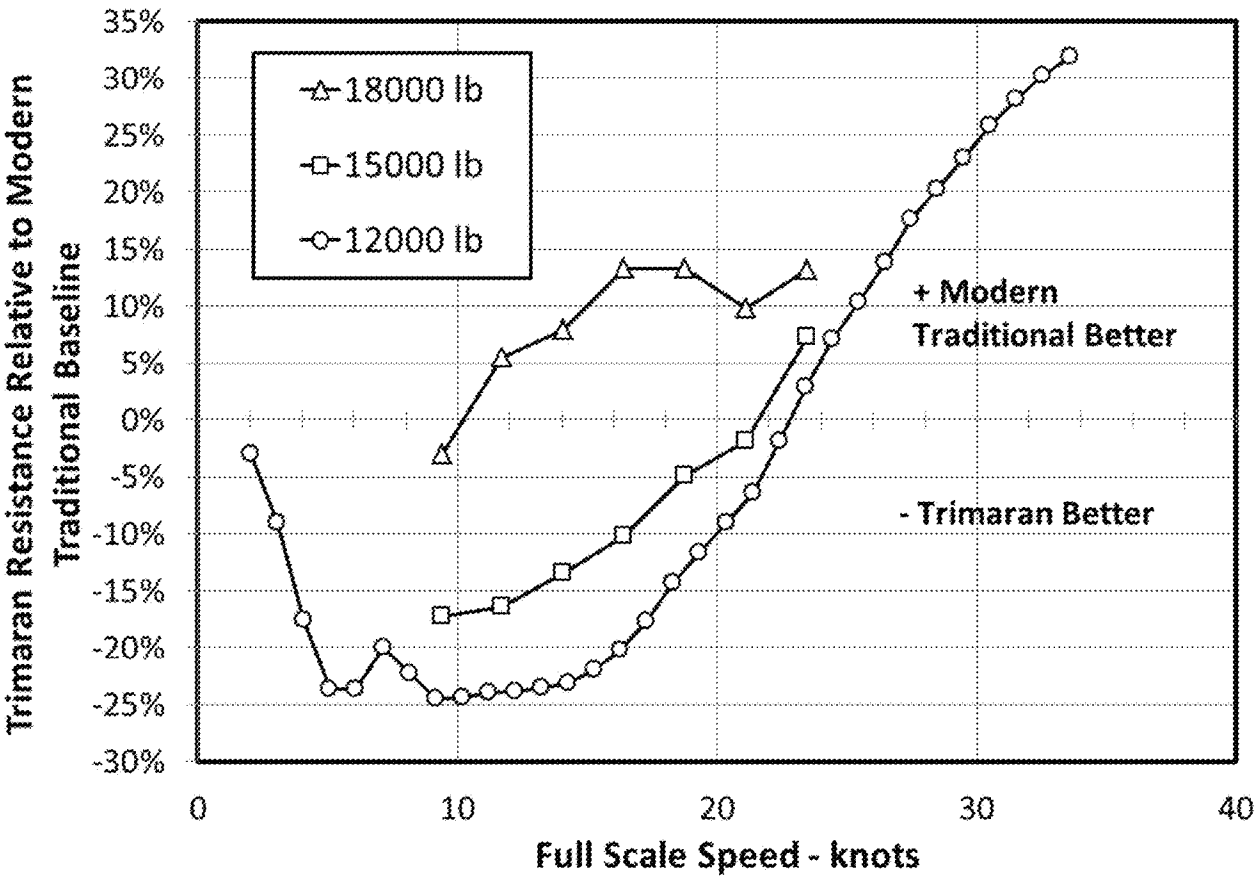
FIG. 23 is a plot of comparative trimaran resistance vs. full scale speed.

The final representation of the calm water data is shown in FIG. 23. This graph shows the power requirement of the trimaran relative to the modern traditional monohull baseline for three displacements. A negative value indicates that the trimaran requires less power at a given speed, while a positive number favors the monohull. The 12000 lb. data represents an average value faired though the data for all the Webb and REI tests for these models. It indicates a large useful range of significant power reduction. From 10 to 16 knots, the power requirement is reduced by 20% or more, dropping to a 10% savings at 20 knots. As mentioned in the wetted surface discussion, modification to the sidehull geometry should extend the 20% range closer to 20 knots.

The 15000 lb. data shows that much of the benefit still exists with 3000 lb. of payload. Reductions of 15% to 5% are indicated in the range from 10 knots to 19 knots. At 18000 lb. the monohull does better over most of the speed range, as discussed in the previous section. Again, 10 knots seems to be the break-even point between the hulls under the heavy loading condition. As the propeller will be less efficient under heavy load, slowing down to 10-12 knots while carrying 6000 lb. may be a method of maintaining efficiency. In practice, current lobster boats would not operate at their normal cruising speed when fully loaded with traps and bait.

REI conducted rough water tests on both hulls under the same conditions. The purpose of these tests was to determine both the seakeeping characteristics (roll and pitch motion, heave acceleration) and the added resistance in waves. Waves in San Diego harbor during these tests correspond to full-scale seas of approximately 2 to 3 ft. (significant wave height), with single waves up to 4 to 5 ft. full-scale. While the measured sea state is relatively benign, it is typical of coastal conditions where the boat would operate, and represents the waves that will most likely wet the 18 inch high cross-deck structure bridging the main and sidehulls on the trimaran. As such these seas present a reasonable test for added resistance in waves.

Figure 24:
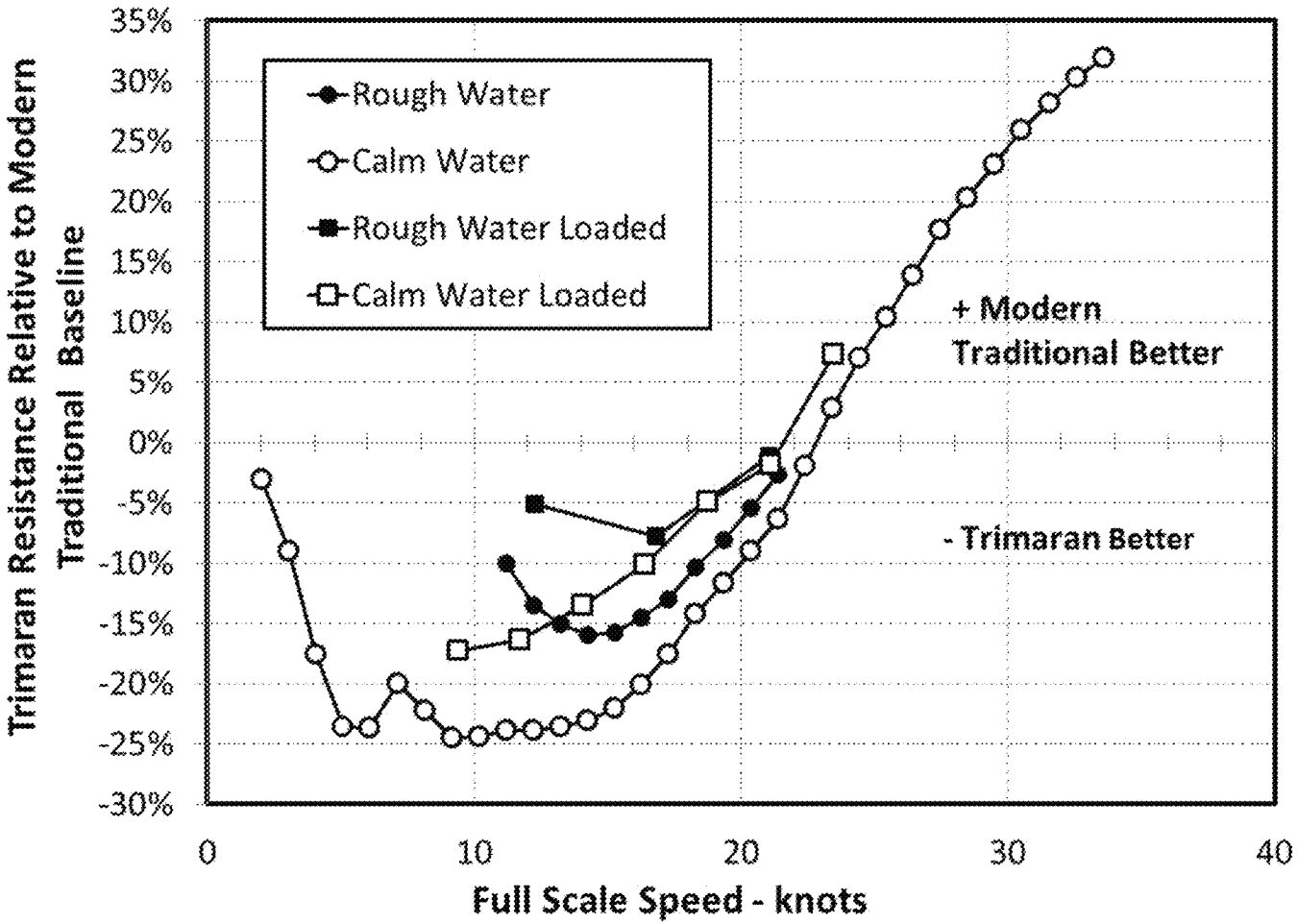
FIG. 24 is a plot of comparative trimaran resistance vs. full scale speed.

The results of the added resistance experiments are shown in FIG. 24. The calm-water results for 12000 and 15000 lb. are repeated from FIG. 23. The added resistance values were calculated according to the ITTC recommendations, using estimates of the increased wetted surface due to waves for each model. The trimaran was assumed to have a higher increase in wetted surface than the monohull due to the wetting of the tunnels. Compared to the dynamic wetted surface used in the calm-water tests, the trimaran wetted surface was assumed to increase an additional 25% in waves while the monohull was assumed to increase an additional 10% over its calm-water dynamic wetted surface values. Note that even though the trimaran wetted surface increases more than the monohull, the total wetted surface of the trimaran is still lower over a large part of the speed range.

The tests show a moderate decrease in the performance benefit of the trimaran at the 12000 lb. displacement. In a portion of desired speed range of interest, say 15 to 18 knots, the trimaran still shows 10% to 15% reduction in power required. At the medium displacement of 15000 lb., the power reduction in waves is very close to the calm water value in the same speed range. The small difference between calm and rough water at the 17 and 21 knot points is probably due to the fact that the cross deck is already adding significant wetted surface in calm water, such that the rough water case does not result in a further increase (at least relative to the monohull).

In addition to the added resistance measurement, each model was equipped with accelerometers to measure heave (vertical) acceleration and roll amplitude. Heave acceleration is measured directly by the accelerometers and normalized by acceleration due to gravity to give units in Gs. Roll amplitude is derived from measured accelerations and presented in degrees. Note that all runs took place in irregular head seas unless otherwise noted.

As seakeeping response is derived from a stochastic process, both heave acceleration and roll amplitude are presented in terms of significant response. In statistical analysis, the significant response is the average of the one-third highest maxima. Say, for example, we measure 300 roll cycles in a given run. Taking the highest 100 of these roll cycles and averaging their amplitude would give the significant roll amplitude. In terms of sea state, the significant wave height corresponds well to the wave height a trained observer (a mariner, fisherman, or other experienced person) would assign to the sea based on a visual inspection.

Figure 25:
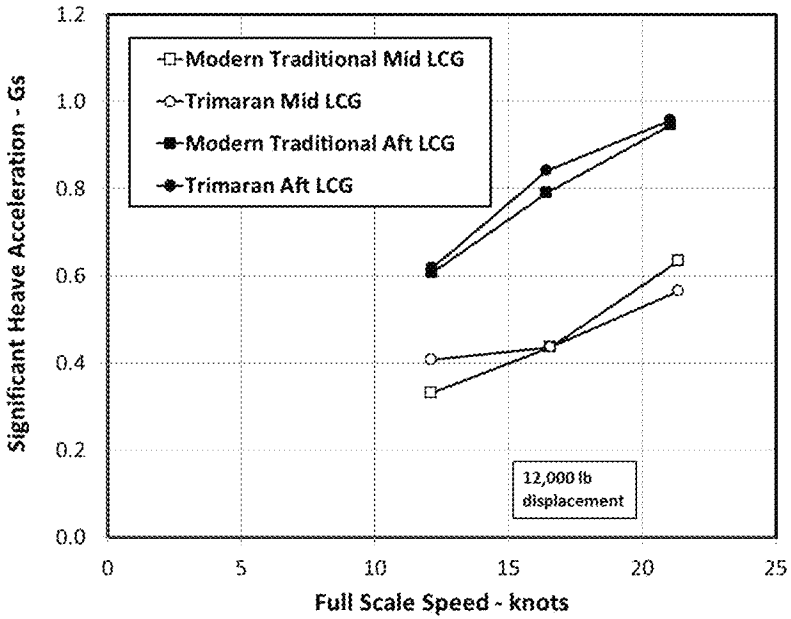
FIG. 25 is a plot of significant heave acceleration vs. full scale speed with 12,000 lb. displacement.

The results for heave and roll are presented in FIGS. 25 to 28. Results are given for two displacements and two LCG positions for each model. FIG. 25, for example, shows the significant heave acceleration at 12000 lb. displacement. Marker type indicates LCG position (open for mid, filled for aft). Since paired model points were tested simultaneously in identical conditions, and to aid in the clarity of the graphs, significant wave height is not shown. Test runs for configurations that have not proved advantageous, such as the outboard sidehull position, are also omitted in the name of clarity.

We see in FIG. 25 that the modern traditional monohull and trimaran have very similar heave response in both LOG positions. The models exhibit the same trends and magnitude of response in each configuration. Due to the stochastic nature of these measurements, the acceptable variation between models is expected to be higher than in the resistance testing. The clear increase in heave acceleration with aft LCG position may be due to heave-pitch coupling. Further speculation or analysis is not undertaken here since the primary goal is to compare the trimaran to the monohull, and both models exhibit the same trend.

Figure 26:
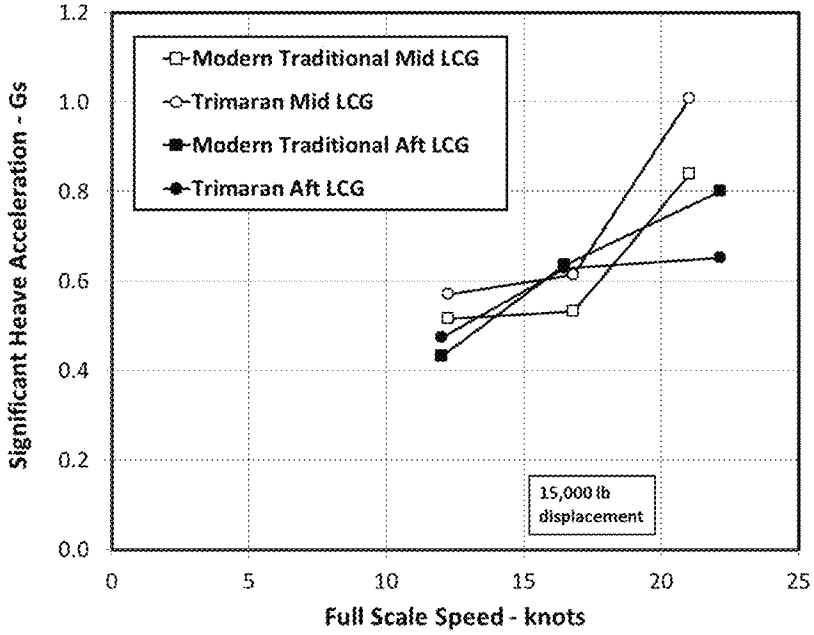
FIG. 26 is a plot of significant heave acceleration vs. full scale speed with 15,000 lb. displacement.

FIG. 26 shows the same values for the medium 15000 lb. displacement. The trends are more consistent for both LCG positions, suggesting the increased submerged volume has tempered the mechanism responsible for the previous behavior. In this case we see a consistent, slightly higher acceleration for the trimaran in the mid LCG position. Acceleration in the aft LCG position is almost identical for both models, except for the highest speed where the monohull is higher. The test at 22 knots is somewhat less important in the context of this report, since the trimaran is not intended to exceed 20 knots.

Figure 28:
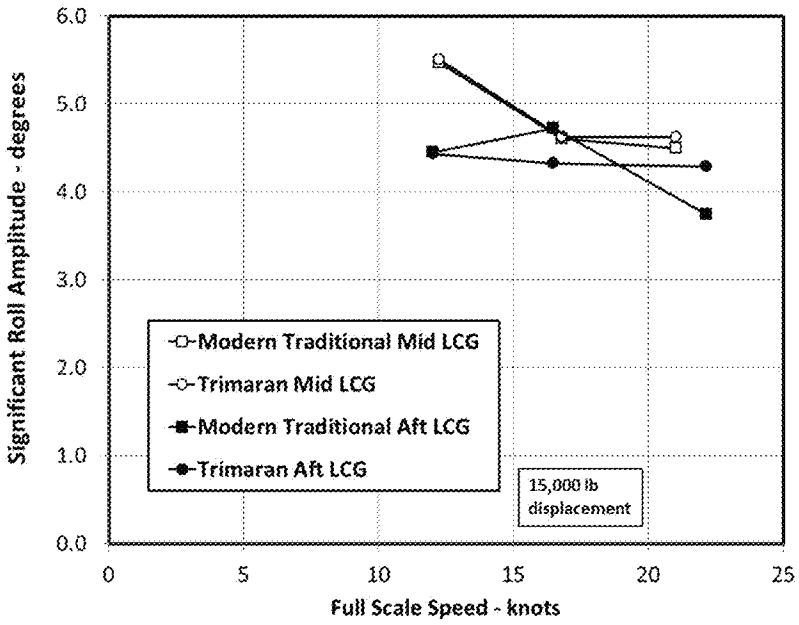
FIG. 28 is a plot of significant roll amplitude vs. full scale speed with 15,000 lb. displacement.
Figure 27:
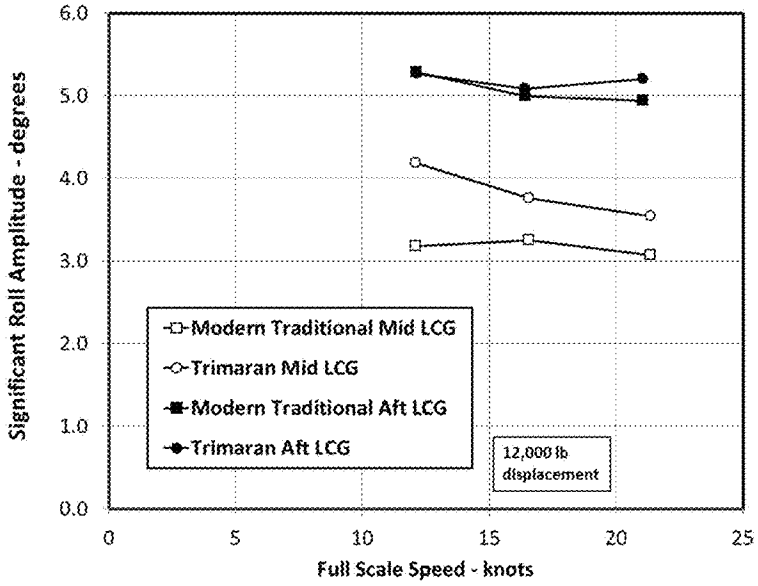
FIG. 27 is a plot of significant roll amplitude vs. full scale speed with 12,000 lb. displacement.

FIGS. 27 and 28 show the results for the significant roll measurement. FIG. 37 shows significant roll amplitude is consistently around five degrees for both models in the aft LCG position. In the mid LCG position, the monohull significant roll is a little over three degrees for all speeds, while the trimaran roll is slightly higher. The difference is not an issue, as both models exhibit significant roll values over five degrees in other conditions. With the monohull as a baseline, significant roll values of 5.5 degrees or less seem to be reasonable.

FIG. 28 shows the same result for the medium 15000 lb. displacement. Just as with the heave acceleration measurement, the performance difference for the LCG positions is less at the heavier displacement. Roll for most cases is about 4.5 degrees, with each model exhibiting one higher value at low speed.

Next the difference between roll amplitude and roll period was considered. Roll amplitude does not describe how long or short the roll period, only the magnitude of the peak-to-peak excursion in roll. One of the advantages of the trimaran is that it can have lower initial stability, leading to a longer less "snappy" roll period. One of the inherent problems with increasing the beam of a monohull is the reduction of roll period, generally leading to increased fatigue for the operator. The trimaran was designed to have less initial stability than either a modern traditional monohull or a catamaran, which should lead to longer roll periods and a more comfortable boat.

Figure 29:
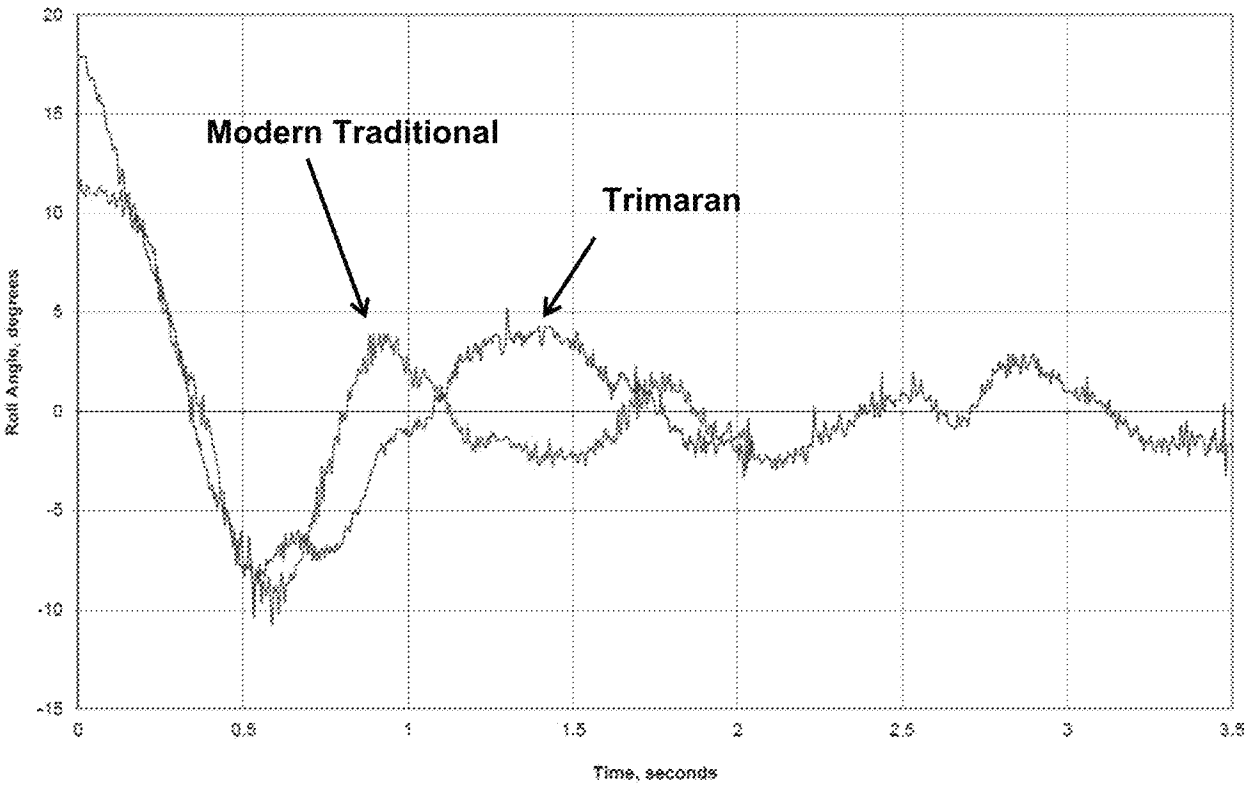
FIG. 29 is a plot of roll angle vs. time.

To test the difference in roll period, a zero speed roll test was undertaken during the REI test in San Diego. With the models instrumented but not attached to the platform, each hull was released from a static heel angle and roll data collected in time. The results are shown in FIG. 29. The trimaran was released from rest at 17 degrees heel and returned to 4 degrees heel after about 1.4 seconds. The monohull was released from rest at 11 degrees heel and returned to 4 degrees heel after about 0.9 seconds. The trimaran thus exhibits about 55% longer roll period, even though it has more beam. This trend was later validated in another experiment in the Maine Maritime Academy pool, where Fourier analysis of natural roll period showed that the model trimaran had a natural roll frequency of about 0.78 Hz (T=1.28 seconds) while the modern traditional model had a natural roll frequency of about 1.27 Hz (T=0.79 seconds) in the same loading condition. It is noted that full scale roll periods would be longer.

None of the heave acceleration or roll amplitude data pointed to any problems with the trimaran design. The performance in these areas was a major question going into the REI tests, but the measured values confirm the observations of similar performance made during testing.

Slamming of the cross-deck structure was also a concern prior to the REI tests. While the model was not instrumented to measure slamming pressures, observations during the test series did not indicate a significant issue with slamming. The largest flat sections of the cross-deck are amidship, where slamming generally does not occur. The trimaran appeared to be very dry. The shape of the forward part of the hull, where the cross-deck tunnel structure fairs into the bow sections, appeared to act as a giant spray rail.

Phase I and Phase II testing demonstrated that the trimaran design shows potential to reduce fuel consumption in the desired speed range (i.e., 14 to 20 knots) while maintaining many of the features important to the monohull. Seakeeping performance is comparable to a current monohull design, with the trimaran showing potential benefits in roll and pitch motions.

The test results show that unless the trimaran is loaded to its heaviest displacement, it always has at least some powering benefit in the 10-20 knot speed range, even in waves. The break-even point with the monohull seems to be about 16000 to 17000 lb displacement, which corresponds to 4000 to 5000 lb. extra payload (5000 lb. is about 100 traps). It was contemplated that the design could be modified slightly to add some flair to the center hull shape just above the 12000 lb. waterline. This change would increase the waterplane area and prevent the hull from sinking as deep when loaded. This is discussed herein in further detail as part of the Phase III Development.

As noted in the desired performance and features section, the desired speed falls somewhere between 14 and 20 knots, based on input from lobstermen. Considering the primary goal of the project is a reduction in fuel consumption, based on Phase I and II testing, it would be beneficial to adopt a speed of about 16 knots for the design. Due to the cubic relation between speed and power, 16 knots generally requires about half the power (and fuel) of 20 knots. Many of the test results from Phase I and Phase II demonstrated that 16 knots may be a "sweet spot" for the design, just before the sidehull flow asymmetry and spray drag become an issue.

Figure 30:
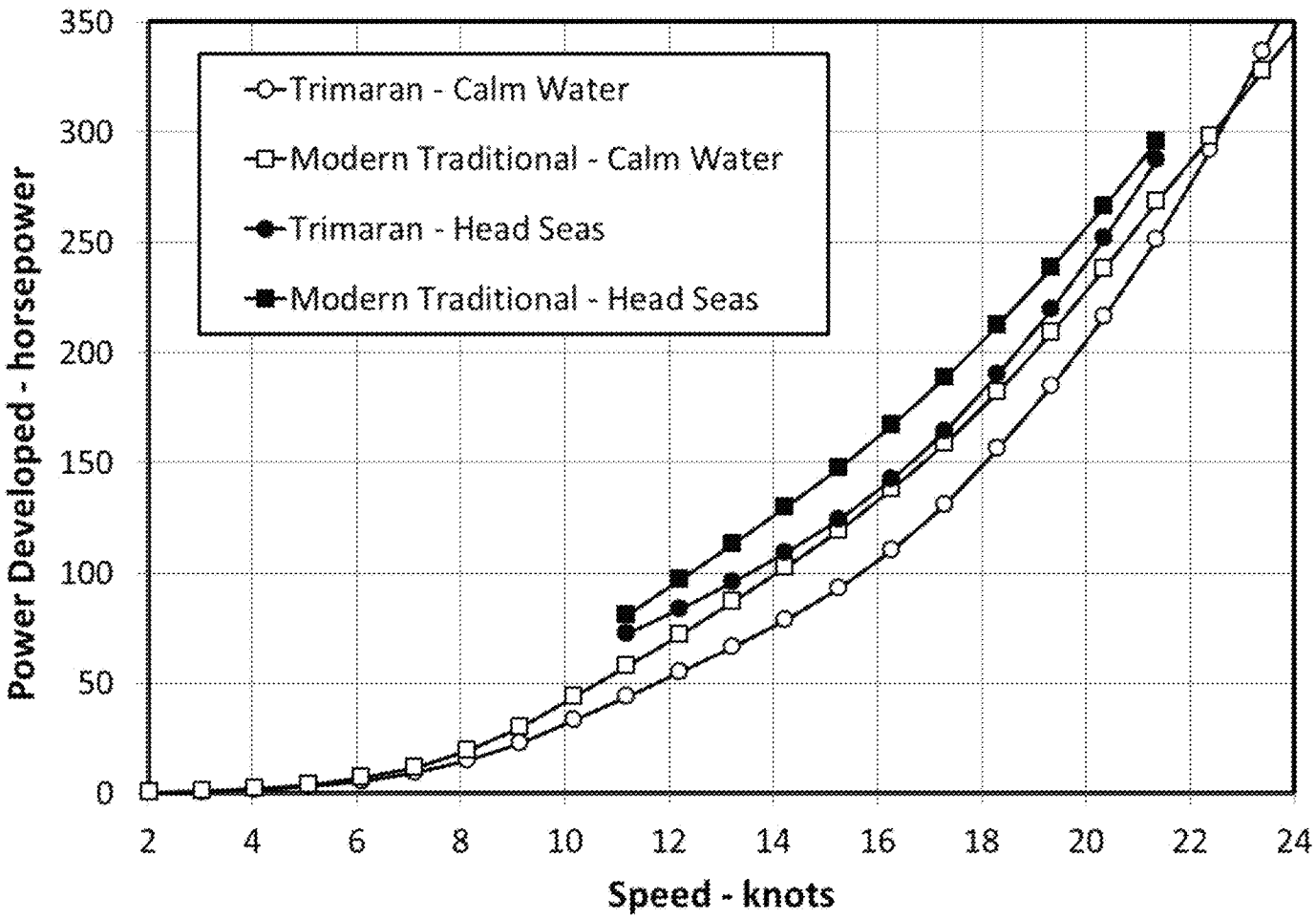
FIG. 30 is a plot of power developed vs. speed in both calm water and head seas.

Final faired speed-power curves for the 12000 lb. displacement case are shown in FIG. 30 for both the calm water and rough water cases. Propeller efficiency is again assumed to be 65%. At 20 knots, the trimaran has 10% lower power requirement than the monohull and needs a little over 200 hp. At 16 knots the trimaran has 20% lower power than the monohull and needs a little over 100 hp. Thus a design speed of 16 knots compared to 20 knots will cut fuel consumption in half. TABLE 5 shows a comparison of fuel consumption for both speeds based on a rough specific fuel consumption of 0.05 GPH/hp.

TABLE 5

| Hull | 16 knots | 20 knots |
|---|---|---|
| Modern Traditional | 6.6 GPH | 11.4 GPH |
| Trimaran | 5.3 GPH | 10.3 GPH |

As discussed herein, it appears the rapid rise in trimaran wetted surface above about 16 knots is due to a significant interaction with the bow wave, such that a large part of the inboard portion of the sidehulls is wetted, eventually generating spray. This increase in wetted surface causes the power requirement saving to drop from 20% to 10% at 20 knots. It appeared the center hull bow wave engulfs the sidehull bow, and may cause the sidehulls to be at an angle of attack relative to the flow (see FIG. 20). The combination of these effects causes a large wave on the inboard surface of the sidehull, including a large amount of spray at high speeds. It was contemplated that further development with regard to the sidehull could extend the 20% power reduction seen from 12-16 knots up to 20 knots. Therefore, Phase III Development was untaken to further improve the power reduction across the full desired speed range (i.e., 14-20 knots). The hull design at the end of Phase II Development will be referred to herein as the "first generation hull" while the hull design following Phase III Development will be referred to herein as the "second generation hull."

Phase III Development

Phase III Development was undertaken to refine and optimize the sidehull shape to address the drag at the higher end (e.g., 16-20 knots) of the desire speed range. In addition, Phase III Development also included changes to the center hull as well.

The first modification made as part of Phase III Development was to the bow of sidehulls 18. The spray observed inside tunnels 22 during the testing of the models during Phase I and II was originally thought to be water riding up the hull. However, as a result of further observation, as discussed herein, it was diagnosed that the spray was due to the center hull bow wave, created by the center hull as the bow cuts through the water, engulfing sidehulls 18. To reduce the spray, thereby reducing the drag and improving the efficiency of the hull, the bow of each sidehull 18 was narrowed to be finer than the previous design, especially on the inboard side.

Figure 31A:
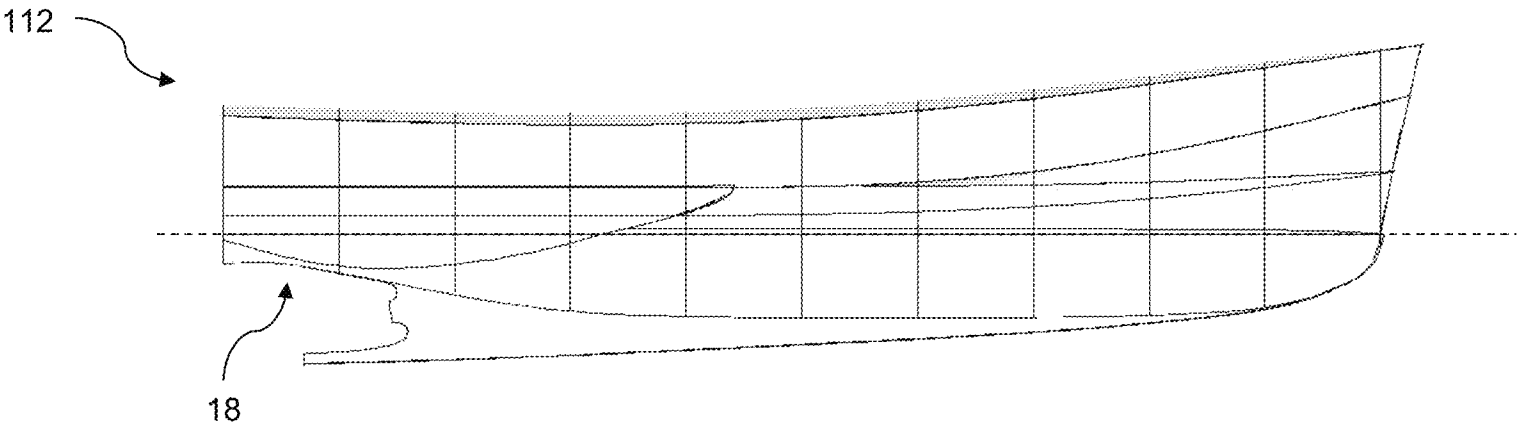
FIGS. 31A and 31B is a side view body plan of a first generation hull and a second generation hull, according to an exemplary embodiment.
Figure 31B:
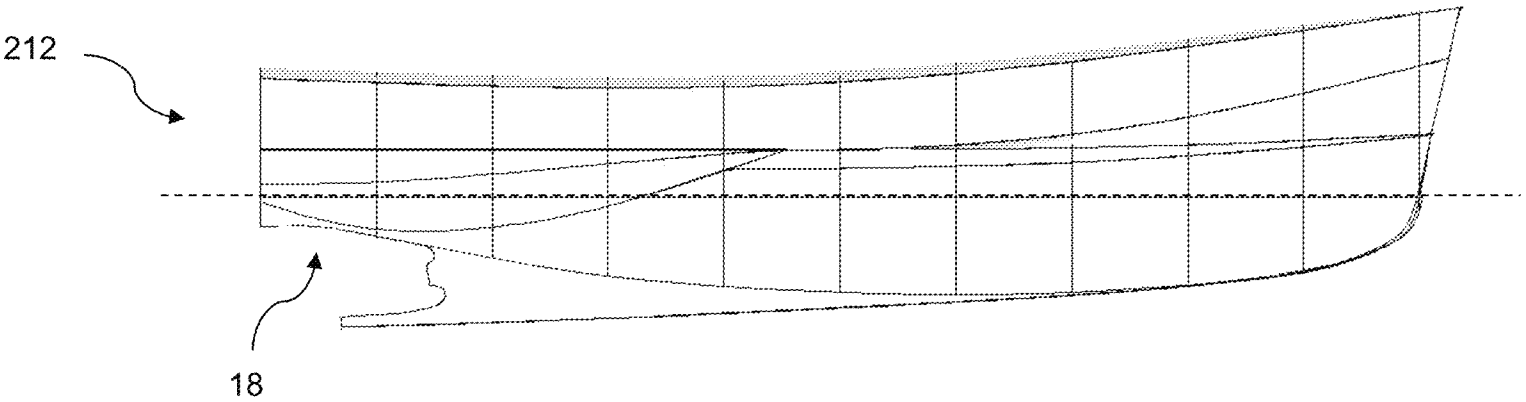
Figure 32:
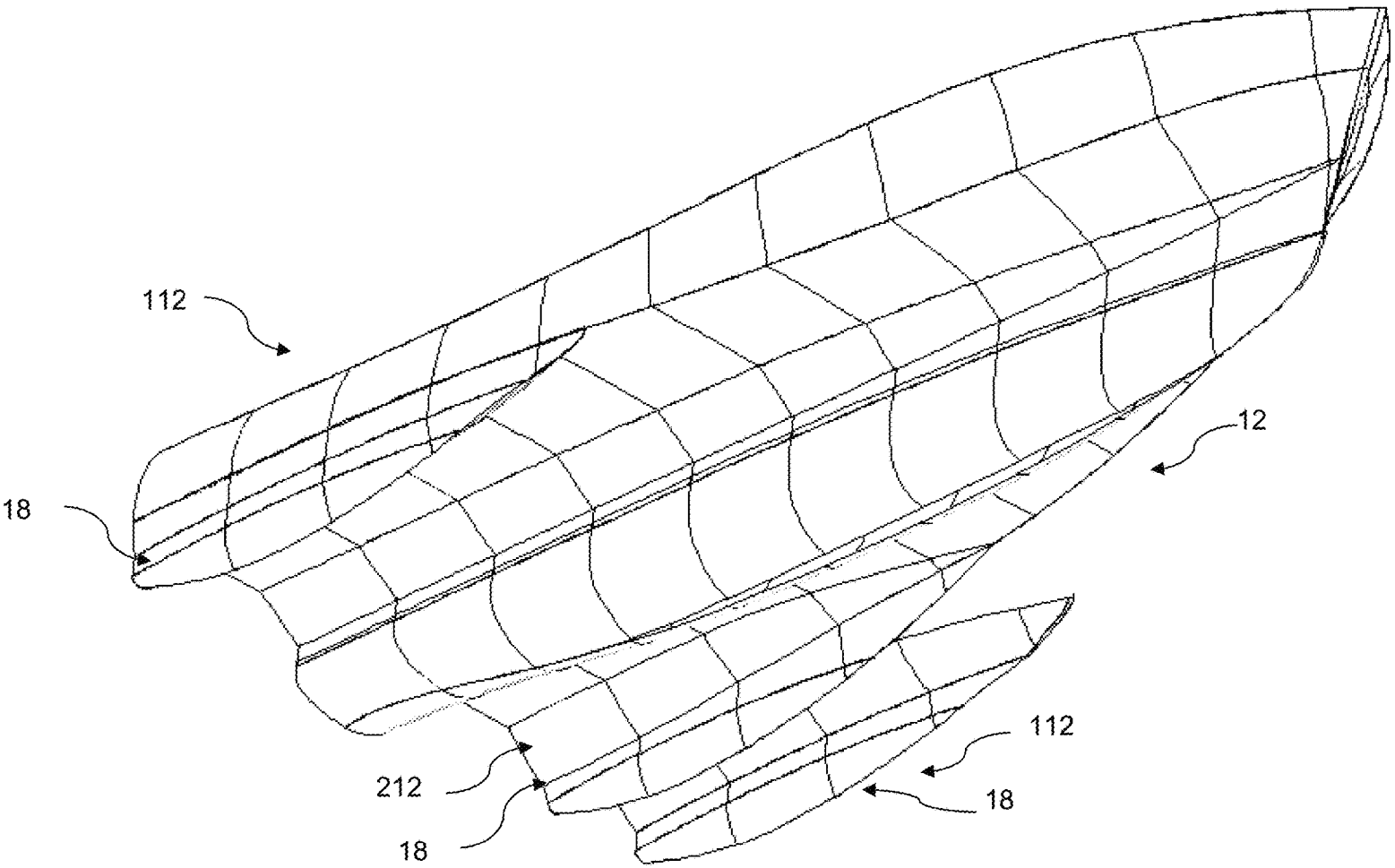
FIG. 32 is a perspective view from underneath the hull of a half first generation hull and a second generation hull, according to an exemplary embodiment.
Figure 33:
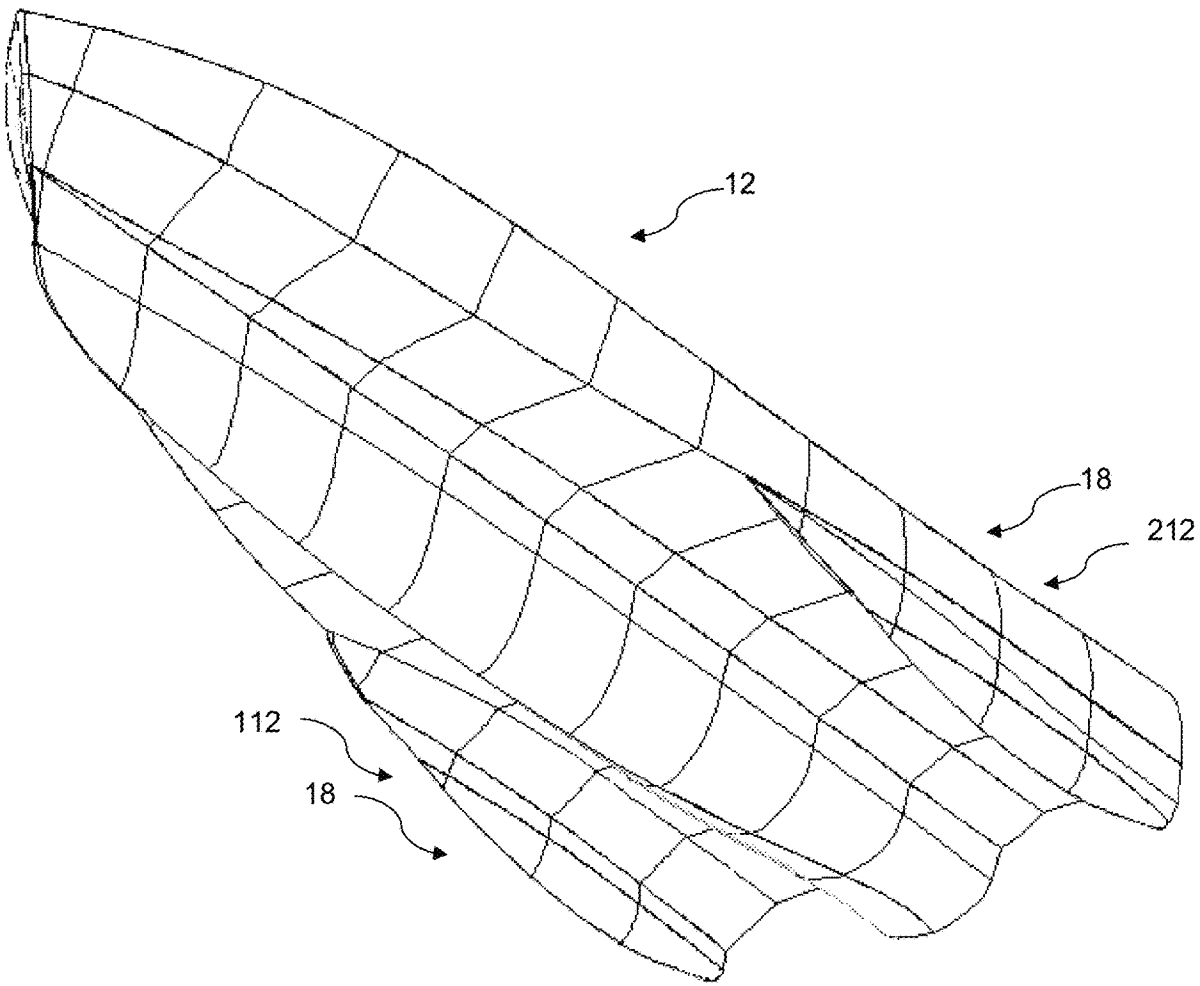
FIG. 33 is a perspective view from underneath the hull of a half first generation hull and a second generation hull, according to an exemplary embodiment.

FIG. 31A shows a side view of the first generation hull 112 and FIG. 31B shows a side view of the second generation of hull 212. As shown in FIG. 31B, sidehull 18 of hull 212 has had the chine separating the sidehull 18 and transition 26 raised toward the bow, producing a finer and narrower leading edge configured to cut through the center hull bow wave. FIG. 32 shows another perspective view of hull 12, wherein hull 12 has one sidehull 18 with the first generation hull 112 design and one sidehull 18 has a second generation hull 212 design. Furthermore, the first generation hull 112 sidehull 18 is also show adjacent to the second generation sidehull to highlight the change in the leading edge of sidehull 18. FIG. 33 provides another perspective view of hull 12 with a first generation hull 112 sidehull and a second generation hull 212 sidehull 118. The leading edge may be finer above the water line, which may help cut through the center hull bow wave more effectively.

Figure 34:
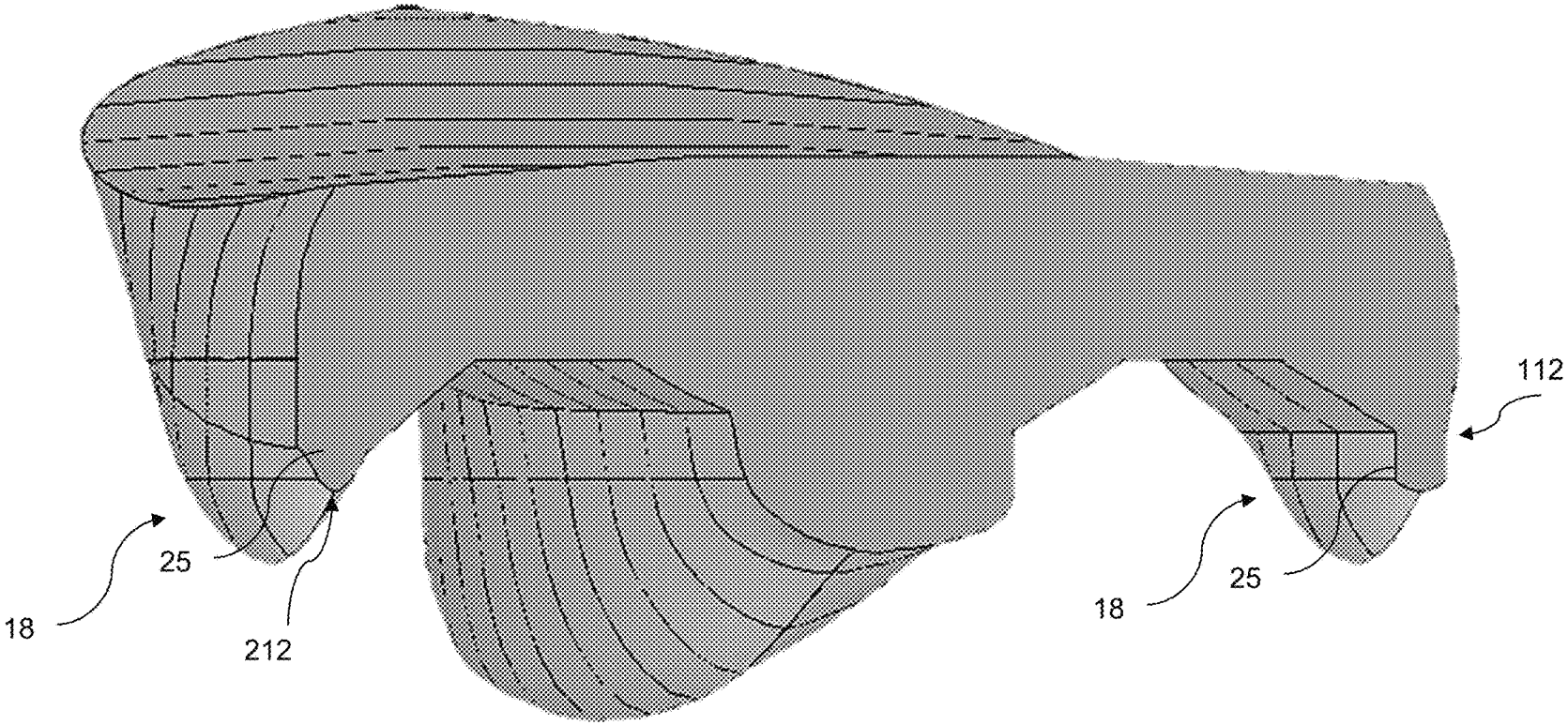
FIG. 34 is a perspective view from behind the hull of a half first generation hull and a second generation hull, according to an exemplary embodiment.

The second modification made as part of Phase III Development was to the transom of the sidehulls 18. During testing it was observed that the first generation hull 112 transoms caused large rooster tails at design speed, which causes increased drag and reduced efficiency. FIG. 34 shows a rear prospective view of combined first and second generation hull 112/212. As shown in FIG. 34, transom 25 of the second generation hull 212 sidehull 18 has been modified to be more angular (e.g., V-shaped) compared to transom 25 of the first generation hull 112 sidehull 18, which is more box like. The more angular "V-shaped" transom 25 of the second generation hull 212 sidehull 18 may be configured to reduce or eliminate the rooster tail in the design speed range.

Figure 35:
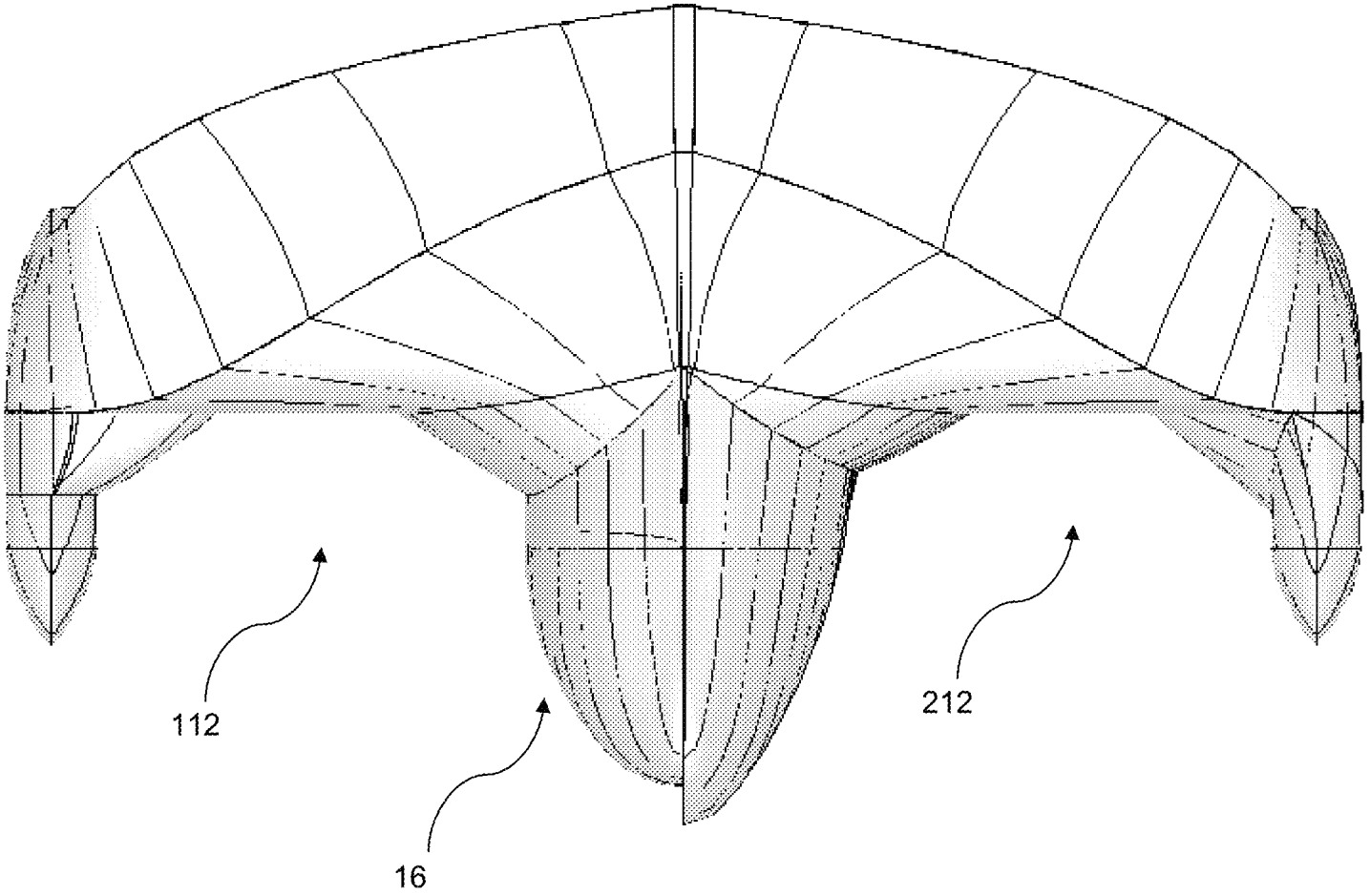
FIG. 35 is a front view of the hull of a half first generation hull and a second generation hull, according to an exemplary embodiment.

The third modification made as part of Phase III Development was to center hull 16. The modification made to center hull 16 was to add flare and decrease keel size. FIG. 35 shows a front view body plan of the hull with the left half showing the first generation hull 112 and the right half showing the second generation hull 212. The flare of center hull 16 above the waterline can create more room for the engine. In addition, the flare may improve loading and decreases degradation of performance as weight increases as was observed during testing during phase I and II development. Continuing the flare below the water line pushes center hull 16 to lower beam-to-draft ratio and decreases keel size, thereby increasing efficiency by reducing keel drag. The modification to sidehulls 18 is also shown in FIG. 35.

As a result of the modifications from Phase III Development, the second generation hull 212, which is fully shown as hull 12 in FIG. 3, the power requirement may be reduced by 20% across the entire desired speed range of 14 to 20 knots. Hull 12 as shown in FIG. 3 may be utilized to produce boat 10 as shown in FIGS. 2A and 2B, according to an exemplary embodiment.

Figure 36:
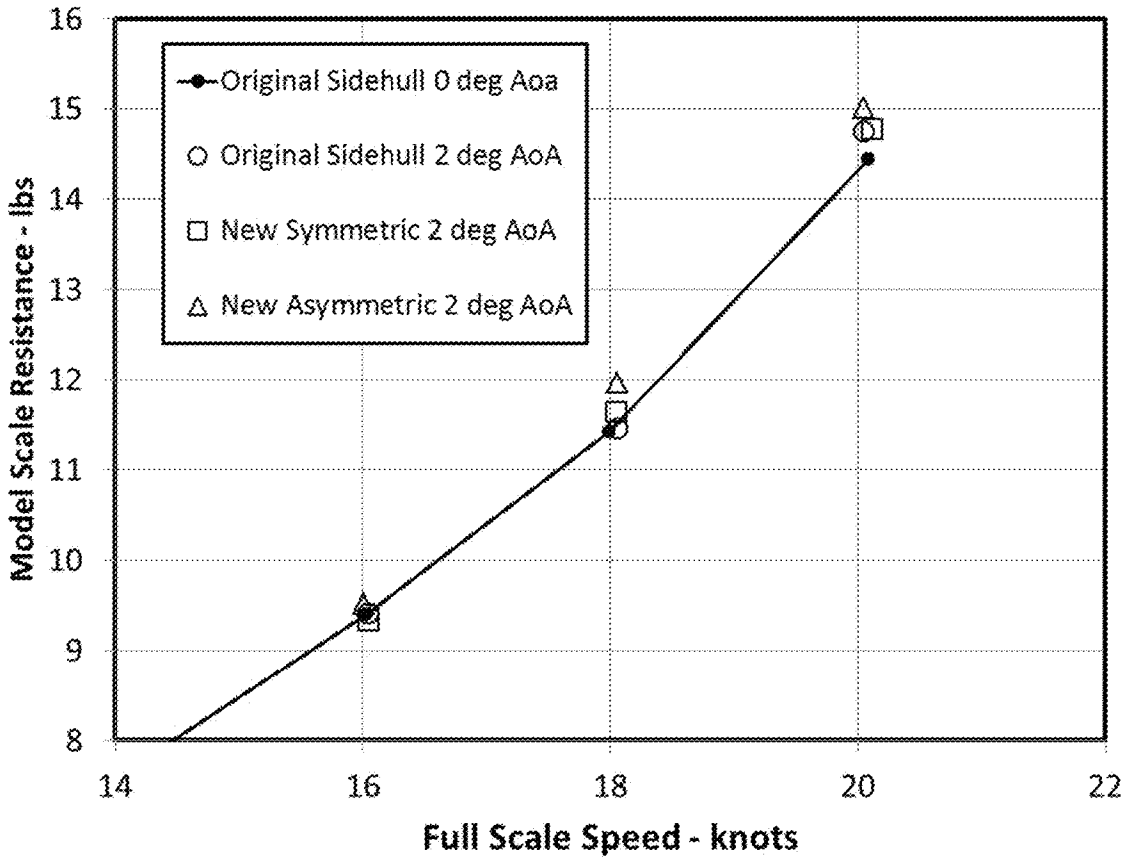
FIG. 36 is a plot of model scale resistance vs. full scale speed.

In an effort to distinguish the details of the flow mechanism causing the spray above 16 knots, a final set of model tests was conducted as part of Phase III. Two additional sidehull sets were produced: one symmetric and one asymmetric. These new sidehulls had their transoms moved slightly forward to avoid the wave trough under the stern (as mentioned in the Phase I discussion). The asymmetric sidehull had a small amount of angle-of-attack built in. All sidehulls were tested in both 0 and 2 degrees angle of attack positions. None of these configurations provided any significant benefit over the original sidehulls at the original 0 degree angle-of-attack position. The results of select tests are shown in FIG. 36. These experiments led to the conclusion that the increased spray at high speed is not due to flow misalignment, and cannot be solved with either angle of attack or spray rails. Combined with video of the flow taken with a camera mounted between the hulls, the results show that the primary issue is that the entire bow of the sidehulls is engulfed in the center hull bow wave, and that the transition 26 between sidehull 18 and the cross-deck structure cannot extend all the way to the bow of sidehull 18 as in previous embodiments. The bow of sidehull 18 must be cut-in on the inboard side to form a sharp entrance for the center-hull wave crest, even in the best sidehull location. These conclusions led to the second generation 212 sidehull modifications described herein.

Boat 10, as described herein may be scaled up or down depending on the desired size and capacity. According to an exemplary embodiment, a length of boat 10 may be about 38 feet. In some embodiments, the length may range, for example, from about 37 feet to about 39 feet, about 36 feet to about 40 feet, about 35 feet to about 41 feet, about 34 feet to about 42 feet, or about 32 feet to about 44 feet. A beam of boat 10 may be about 15 feet. In some embodiments, the beam may range, for example, from about 14 feet to about 16 feet, about 13 feet to about 17 feet, or about 12 feet to about 18 feet. A draft of boat 10 may be about 4 feet and 1 inch. In some embodiments, the draft may range, for example, from about 4 feet to 5 feet, 3.5 feet to 4.5 feet, or 3 feet to 4 feet. A length design waterline of boat 10 may be about 36 feet and 8 inches. In some embodiments, the length design waterline may range, for example, from about 36 feet to about 38 feet, about 35 feet to about 39 feet, about 34 feet to about 40 feet, or about 32 feet to about 42 feet. A displacement of boat 10 may be about 12,200 lbs. In some embodiments, the displacement may range, for example, from about 10,000 lbs to about 12,500 lbs, about 12,500 lbs to about 15,000 lbs, about 15,000 lbs to about 17,500 lbs, about 17,500 lbs to about 20,000 lbs, or about 7,500 lbs to about 10,000 lbs.

Figure 37C:
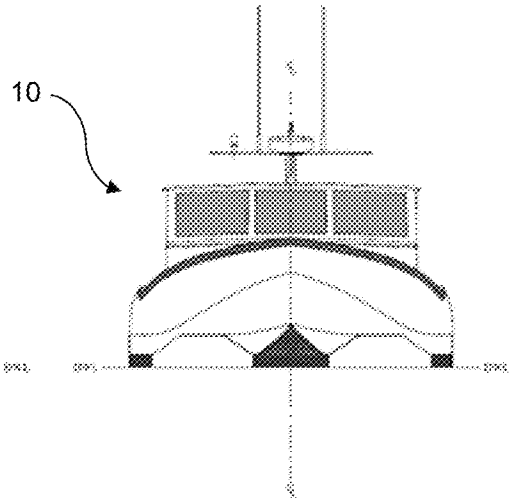
FIGS. 37A, 37B, and 37C are a side view, top view, and front view of a lobster boat, according to an exemplary embodiment.
Figure 37A:
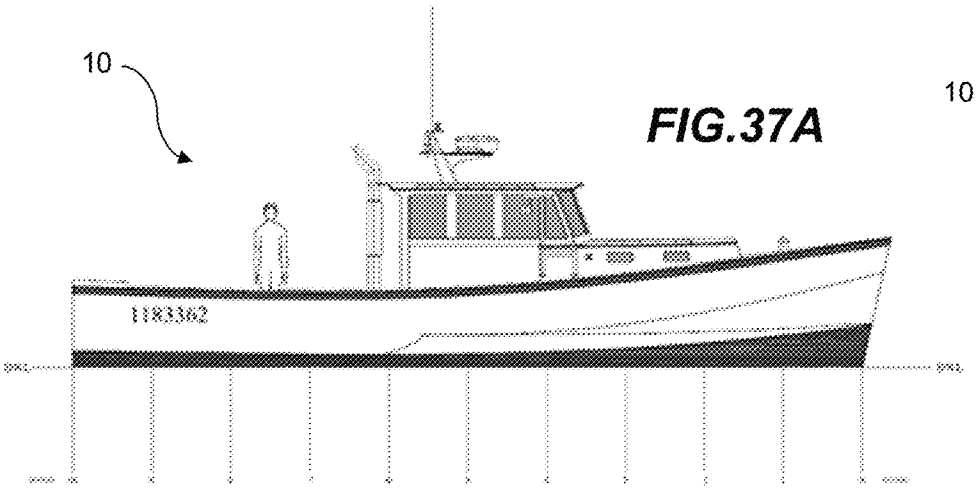
Figure 37B:
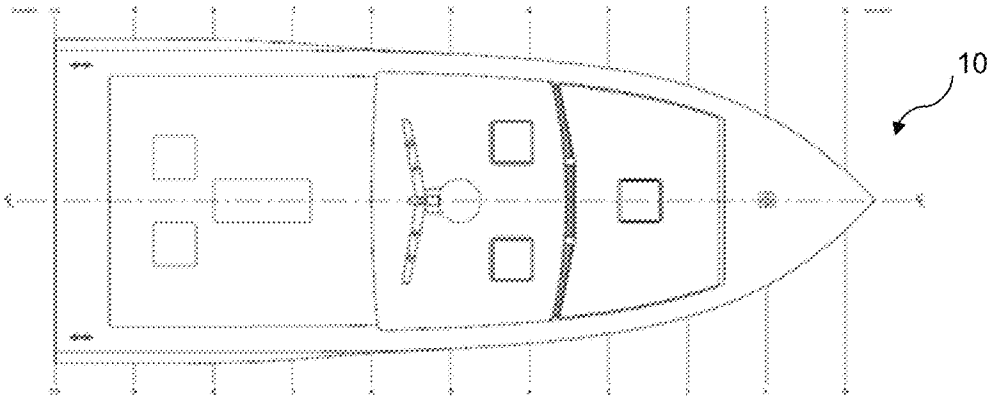

FIGS. 37A-37C show one embodiment of boat 10, according to an exemplary embodiment. Please note, only the above water line portion of the hull is shown in FIGS. 37A and 37C.

As described herein, boat 10 may be scaled up or down from the design length utilized during Phase I, Phase II, and Phase III of development. It is noted, that as the length of boat 10 is scaled up or down the preferred speed range may vary dependent on the length. The relationship between the length and the preferred speed range may be described by the Speed-Length ratio (Equation 4) for boats, where U is speed in knots and LWL is length of water line in feet, or by Froude number $F_r$ (Equation 5) for ships, where V is the velocity, L is the waterline length, g is gravity (in consistent units):

$$\text{Speed} - \text{Length Ratio} = \frac{U}{\sqrt{LWL}} \qquad \text{Equation (4)}$$

$$Fr = \frac{V}{\sqrt{gL}} \qquad \text{Equation (5)}$$

For a length of 36 feet (10.9728 meters), and a speed of 16 knots (8.2311 meters/sec), and gravity of 9.81 m/s$^2$, the speed-length ratio is about 2.67 while the Froude number is about 0.80. For the same length at a speed of 20 knots (10.2889 meters/sec), the speed-length ratio is about 3.33 while the Froude number is about 1.00. Therefore, according to an exemplary embodiment, the preferred (e.g., most efficient) speed-length ratio may be, for example, about 2.67 to about 3.33 and the preferred Froude number range may be, for example, about 0.80 to about 1.00.

By maintaining these ranges of the speed-length ratio and/or the Froude number, the preferred speed range may be determined for boat 10 as it is scaled up or scaled down. For example, Table 7 below shows the preferred speed range for lengths of 32 feet to 50 feet.

TABLE 7

| Length (ft) | Cruise Speed (knots) (Speed-Length Ratio = 2.67) (Froude Number = 0.80) | Max Speed (knots) (Speed-Length Ratio = 3.33) (Froude Number = 1.00) |
|---|---|---|
| 32 | 15.1 | 18.9 |
| 36 | 16.0 | 20.0 |
| 40 | 16.9 | 21.1 |
| 50 | 18.9 | 23.6 |

Other embodiments of the present disclosure will be apparent to those skilled in the art from consideration of the specification and practice of the present disclosure disclosed herein. It is intended that the specification and examples be considered as exemplary only, with a true scope and spirit of the present disclosure being indicated by the following claims.

What is claimed is:

1. A trimaran boat, comprising:

a pair of sidehulls;

a center hull positioned between the pair of sidehulls;

a deck extending substantially continuous from one sidehull across the center hull to the other sidehull; and a pair of center hull transitions and a pair of sidehull transitions;

wherein the pair of sidehulls each have a length between about 35% and about 45% of a length of the center hull, a transom of each sidehull is generally flush with a transom of the center hull, a design water line length of the boat is about 36 to about 38 feet, a beam of the boat is about 15 feet, the center hull has a beam width of about 3.5 feet, and a centerline of each sidehull is about 7 feet from a centerline of the center hull;

wherein the boat has optimum energy efficiency at speed between 14 and 20 knots.

2. A trimaran boat, comprising:

a pair of sidehulls each having a v-shaped transom;

a center hull positioned between the pair of sidehulls;

a deck extending substantially continuous from one sidehull across the center hull to the other sidehull; and a pair of center hull transitions and a pair of sidehull transitions;

wherein the pair of sidehulls each have a length between about 35% and about 45% of a length of the center hull; and wherein the boat has optimum energy efficiency within a predetermined cruising speed range.

3. The trimaran boat of claim 2, wherein a transom of each sidehull is generally flush with a transom of the center hull.

4. The trimaran boat of claim 2, wherein the deck is configured to store a plurality of lobster pots.

5. The trimaran boat of claim 2, wherein operating at about 16 knots the boat has about a 20% lower power requirement than a comparable monohull boat.

6. The trimaran boat of claim 2, wherein a design water line length of the boat is about 36 to about 38 feet.

7. The trimaran boat of claim 2, wherein the center hull has a beam width of about 3.5 feet.

8. The trimaran boat of claim 2, wherein a centerline of each sidehull is about 7 feet from a centerline of the center hull.

9. The trimaran boat of claim 2, wherein a beam of the boat is about 15 feet.

10. The trimaran boat of claim 2, wherein an engine is positioned in the center hull.

11. The trimaran boat of claim 2, wherein the center hull has a keel and a draft of about 4 feet and 1 in.

12. The trimaran boat of claim 2, wherein the boat has about a 100 horsepower engine and with a displacement of about 12,000 lbs and a propeller efficiency of 65%, the boat consumes about 5.3 gallons per hour of fuel or less operating at about 16 knots.

13. The boat hull of claim 2, wherein the boat has about a 200 horsepower engine and with a displacement of about 12,000 lbs and a propeller efficiency of 65%, the boat consumes about 10.3 gallons per hour of fuel operating at about 20 knots.

14. A boat hull comprising:

a pair of sidehulls;

a center hull positioned between the pair of sidehulls; and a deck extending substantially continuous from one sidehull across the center hull to the other sidehull;

a pair of center hull transitions and a pair of sidehull transitions;

wherein a transom of each sidehull is v-shaped and each sidehull includes a chine between the deck and the waterline that extends a length of the sidehull, the chine runs down toward the waterline moving toward a stern of the boat;

wherein the boat has optimum energy efficiency within a predetermined cruising speed range.

15. The boat hull of claim 14, wherein the pair of sidehulls each have a length less than half a length of the center hull and are positioned outboard and aft at each side of the hull such that the transom of the sidehulls is generally aligned the transom of the center hull.

16. The trimaran boat of claim 14, wherein operating between a speed-length ratio of about 2.67 to about 3.33 provides a maximum energy efficiency.

17. The boat hull of claim 14, wherein operating between a Froude number of about 0.80 to about 1.00 minimizes the power requirement for the hull.

18. The boat hull of claim 14, wherein the sidehulls are configured and positioned to cut through a bow wave created by the center hull, thereby reducing spray.

19. The boat hull of claim 14, wherein the hull has a lower powering requirement than a comparable monohull boat experiencing the same conditions when it has a displacement of less than about 16,000 lbs and operating in a speed range of about 10 knots to about 20 knots.

* * * * *